US009869082B1

(12) United States Patent
Mann

(10) Patent No.: US 9,869,082 B1
(45) Date of Patent: Jan. 16, 2018

(54) CULVERT DIFFUSER

(71) Applicant: Alexander W. Mann, Thorndike, ME (US)

(72) Inventor: Alexander W. Mann, Thorndike, ME (US)

(73) Assignee: State of Maine Department of Transportation, Augusta, ME (US)

( * ) Notice: Subject to any disclaimer, the term of this patent is extended or adjusted under 35 U.S.C. 154(b) by 0 days.

(21) Appl. No.: 15/340,397

(22) Filed: Nov. 1, 2016

(51) Int. Cl.
*E03F 1/00* (2006.01)
*F15D 1/02* (2006.01)

(52) U.S. Cl.
CPC . *E03F 1/00* (2013.01); *F15D 1/02* (2013.01)

(58) Field of Classification Search
CPC combination set(s) only.
See application file for complete search history.

(56) References Cited

U.S. PATENT DOCUMENTS 929,784 A * 8/1909 Norquist ..... E01F 5/005 405/125
1,048,153 A * 12/1912 Haight ..... E01F 5/005 405/125
1,124,284 A * 1/1915 Brown ..... E01F 5/005 138/175
1,228,662 A * 6/1917 Good ..... E01F 5/005 405/125
1,258,751 A * 3/1918 Dean ..... E01F 5/005 405/125
1,620,089 A * 3/1927 Fischer ..... E01F 5/005 405/125
2,263,588 A * 11/1941 Odendahl ..... E01F 5/005 405/125
3,777,786 A * 12/1973 Gray ..... E01F 5/005 138/109
7,798,175 B2 * 9/2010 McBride ..... F15D 1/02 138/37
2011/0206461 A1 * 8/2011 Davis ..... E01F 5/005 405/125

* cited by examiner

*Primary Examiner* — Kyle Armstrong
(74) *Attorney, Agent, or Firm* — Anthony D. Pellegrini

(57) ABSTRACT

The present invention embodies a diffuser extending from the outlet end of a highway culvert, whereby the diffuser flares outwardly to provide a larger area cross-section at the outlet of the culvert in order to increase the capacity of the culvert and to reduce the effects of erosion from the outflow of water from the culvert outlet.

8 Claims, 26 Drawing Sheets

- The conical inlet AB increases expenditure (flow rate) as 12.1 to 10 over orifice alone.
- Addition of a conical outlet CD to a pipe with a conical inlet increases expenditure (flow rate) as 24 to 12.1.
- The conical inlet AB in combination with the conical outlet CD increases the flow "in proportion of twenty four to ten" over the orifice alone.

- The conical inlet AB increases expenditure (flow rate) as 12.1 to 10 over orifice alone.
- Addition of a conical outlet CD to a pipe with a conical inlet increases expenditure (flow rate) as 24 to 12.1.
- The conical inlet AB in combination with the conical outlet CD increases the flow "in proportion of twenty four to ten" over the orifice alone.

Fig. 5. 24-inch Vitrified Clay Pipe; Length 38.3 Feet
Straight Endwall Entrance

Fig. 4. Test No. 1192

$A_R = Ao/Ap$ $L_R = L_d/D_p$ $\theta$ = Half angle flare

FIG. 2 FLOW CONDITIONS IN A 7.5-DEGREE DIFFUSER

Each contour represents a pressure equal to 6.5" of water.

| Date | Rainfall (in) | Duration (hr) | Peak Water Level (ft) | Attached Flow |
|---|---|---|---|---|
| 9/30/2015 | 5 | 16 | 3.54 | Yes |
| 10/29/2015 | 2.14 | 24 | 2.11 | Yes |
| 11/20/2015 | 1.57 | | 2.32 | Yes |
| 1/10/2016 | 2.51 | 10 | 3.54 | Yes, flow damaged inlet stonework |
| 2/17/2016 | 1.51 | | 3.25 | Diffuser detached, pipe full – inlet damage affected flow |
| 2/19/2016 | | | | Inlet damage repaired |
| 2/25/2016 | 1.26 | | 2.36 | Yes |
| 3/2/2016 | 1.08 | | 2.21 | Pipe full, high water not observed |
| 3/27 – 3/28/2016 | 1.08 | | 2.03 | Pipe full, diffuser not attached |
| 4/7 – 4/8/2016 | 1.6 | | 3.25 | Yes |

Figure 20

| October 29, 2015 | | | | |
|---|---|---|---|---|
| Time | Inlet Water Depth (ft) | $H_W/D$ | Outlet Water Depth (ft) | Diffuser Attachment |
| 12:44PM | 2.07 | 1.66 | 1.167 | Totally attached |
| 12:55PM | 2.03 | 1.62 | 1.167 | On Verge of Detaching |
| 1:20PM | 2.00 | 1.60 | 1.156 | Water detached from Diffuser, Pipe full |
| 3:13PM | 1.82 | 1.46 | 1.043 | On Verge of detaching from Pipe section |
| 4:30PM | 1.70 | 1.36 | 0.997 | ¼ of Pipe detached |
| 4:47PM | 1.66 | 1.32 | 0.984 | Fiberglass Pipe totally detached |

Figure 21

| Water Level (ft) | $H_W/D$ | Water Surface Area ($ft^2$) | $\Delta H_W$ (ft/min) | $Q_{total}$–$Q_{leakage}$ $ft^3$/sec ($A^* \Delta H_W$-$Q_{leakage}$) | $Q_{p(Avg)}$ $ft^3$/sec | $V_p$ ft/sec ($Q_{avg}/A_P$) | $V_D$ ft/sec ($V_P/A_R$) | Outlet Condition |
|---|---|---|---|---|---|---|---|---|
| 2.5 | 2 | 30270 | -0.041 | 19.68 | 18.68 | 15.22 | 7.61 | Diffuser |
| | | | -0.037 | 17.67 | | | | |
| 2.25 | 1.8 | 27828 | -0.041 | 18.02 | 17.09 | 13.93 | 6.96 | Diffuser |
| | | | -0.037 | 16.16 | | | | |
| 2.00 | 1.6 | 25387 | -0.041 | 16.35 | 16.36 | 13.49 | 6.75 | Diffuser |
| | | | -0.042 | 16.77 | | | | Starts to Detach |
| 1.875 | 1.5 | 24137 | -0.041 | 15.49 | 14.69 | 11.97 | 5.98 | Diffuser |
| | | | -0.037 | 13.88 | | | | Detached |
| 1.75 | 1.4 | 22887 | -0.041 | 14.64 | 13.87 | 11.30 | 5.65 | Pipe |
| | | Upper Marsh | -0.037 | 13.11 | | | | Starts to Detach |
| 1.50 | 1.2 | 20387 | -0.041 | 12.93 | 13.10 | 10.67 | 5.34 | Pipe |
| | | | -0.042 | 13.27 | | | | Detached |
| 1.25 | 1.0 | 17887 | -0.036 | 9.73 | 9.28 | 7.56 | 3.78 | Pipe Detached |

Figure 23

| 6" from Left | 12" from Left | Center | 12" from Right | 6" from Right |
|---|---|---|---|---|
| 4 – 5.3ft/sec | 7.8 – 8.6ft/sec | 7.5 – 8.6ft/sec | 7 – 8.2ft/sec | 6.8ft/sec |

| Stage (ft) | Water Surface Area ($ft^2$) | Volume of Water Stored ($ft^3$) | Cultural Feature |
|---|---|---|---|
| 3.5 | 40000+/- | 35135 | |
| 3.25 | 37576+/- | 32703 | Road Elevation |
| 3 | 35152 | 30270 | Lidar Contour ~478' |
| 2.75 | 32711 | 27800 | |
| 2.5 | 30270 | 25329 | |
| 2.25 | 27829 | 22858 | |
| 2 | 25387 | 20387 | |
| 1.75 | 22887 | 17339 | |
| 1.667 | | | Upper Marsh Surface |
| 1.5 | 20387 | 14291 | |
| 1.25 | 17887 | 11242 | Inlet Crown |
| 1 | 15387 | 8194 | Lidar Contour ~ 476' |
| .75 | 11791 | 6396 | |
| .5 | 8194 | 4597 | |
| .25 | 4597 | 2799 | |
| 0 | 1000 | 0 | Pipe Inlet Invert ~475 |

*(The water surface areas were derived from areas measured at the 476' and 478' contours and an estimated 1000 $ft^2$ ponded area at an elevation of 475', the elevation of the pipe invert. The areas were extrapolated between these values derive the areas at the intervening stages. The rapidly increasing amount of Lidar coverage and increasingly sophisticated interpretation techniques will result in significant improvements to the Stage – Water Surface Area values. The refined areas will in turn result in refinement of the calculated flows derived from this method.)*

Figure 29

CULVERT DIFFUSER

STATEMENT OF GOVERNMENT LICENSE RIGHTS

This invention was made with government support by the Maine Department of Transportation and the Federal Highway Administration. The government has certain rights in the invention.

BACKGROUND OF THE INVENTION

Technical Field

The present invention relates generally to the field of culverts. More particularly, the present invention is directed to a diffuser intended to be attached to the outlet of a culvert used under roadways in order to increase the capacity of the culvert and to reduce the effects of erosion from the outflow of water from the culvert outlet.

Description of Prior Art

Aging infrastructure and changing weather patterns present the need to increase the capacity of existing highway culverts. Water traveling through a straight pipe culvert has a rate of flow which, relative to the inside diameter of the culvert, dictates the amount of water that can flow through the culvert. Older culverts were often undersized, or if initially properly sized, changing environmental conditions resulting in more water needing to be moved therethrough resulted in culverts becoming undersized. Additionally, older culverts often have deteriorated through normal use over the years to the extent that they no longer function correctly. Correcting the problem of undersized and/or deteriorated culverts has traditionally meant replacement of the culverts. This, though, is costly, and often times the geography of the location, or later added infrastructure, prevents easy replacement or the ability to upsize culvert capacity.

In addition, the flow of water from a culvert often causes erosion to the terrain onto which the water flows. Over time, this erosion can greatly alter the terrain and cause changes to how the outflow of water travels away from the culvert. Minimizing erosion from the outflow of water is therefore a desired goal.

One solution for repairing deteriorated culverts is to place a liner within the existing culvert. The liner may be made of metal or, more typically, a plastic or composite material, such as high density polyethylene, polyvinyl chloride, or fiberglass. While placing a liner within an existing culvert is a simple and cost effective method of addressing deteriorated culverts, the liner necessarily reduced the inside diameter of the culvert, thereby exacerbating capacity issues.

It is evident that there is a need for a system for repairing or retrofitting culverts that addresses the need for increased culvert capacity. Additionally, there is a need to reduce erosion from the outflow of water from culverts.

It is therefore an object of the present invention to provide a culvert diffuser which can increase culvert capacity.

It is another object of the present invention to provide a culvert diffuser which can decrease the outlet velocity of the water which is, to a large extent, responsible for the erosion caused by water at the culvert outlet.

It is yet another object of the present invention to provide a culvert diffuser which can be used with a culvert liner.

It is yet another object of the present invention to provide a culvert diffuser which can be used with a culvert liner to provide for less expensive repair of a deteriorated culvert while maintaining or increasing water flow therethrough.

It is yet another object of the present invention to provide a culvert diffuser which can be used with a culvert liner to provide for less expensive retrofit of an undersized culvert to increase water flow therethrough.

It is yet another object of the present invention to provide a culvert diffuser which reduces erosion from the outflow of water from a culvert.

Other objects of the present invention will be readily apparent from the description that follows.

SUMMARY OF THE INVENTION

The present invention comprises an outlet diffuser which is used with a highway culvert to increase pipe capacity and reduce outlet losses. Coupled with properly designed culvert inlets and outlet weirs, the diffuser of the present invention allows existing culverts to be retrofitted for increased life while maintaining, or even increasing, performance. Moreover, erosion from the outflow of water is reduced. The present invention solves both these problems by using hydrodynamic principles to increase the rate of flow of water through a culvert having the same inside diameter. Thus, a liner can be used to repair deteriorated culverts, and the reduced inside diameter of the repaired culvert is more than offset by the increased rate of flow of the water, thereby increasing previous capacity of the culvert. Even where the culvert is in good condition, adding a liner modified with the present invention will result in increased culvert capacity.

The second benefit of the present invention is achieved by different hydrodynamic principles acting on the same device. Water flowing through a culvert has a substantial amount of kinetic energy, and that energy contributes to the erosion of the terrain onto which the water flows. The diffuser of the present invention reduces the kinetic energy of the water as it exits the culvert, thereby reducing erosion.

In simplified form, both effects described herein—increased culvert capacity and reduced erosion at the culvert outlet—are achieved by mounting the diffuser of the present invention to the outlet of the culvert. The diffuser widens the outlet end of the culvert by having sides which angle outward relative to the longitudinal axis of the culvert, thereby providing a larger cross-sectional area at the outlet of the culvert. The precise flare angles and overall length of the diffuser result in hydrodynamic properties creating forces on the water which cause an increase in the rate of flow. The larger cross-sectional area diffuses the kinetic energy as the water exits the culvert. A more detailed explanation is provided below.

Other features and advantages of the present invention are described below.

DESCRIPTION OF THE DRAWINGS

FIG. 20 depicts, in tabular format, storm events and active diffuser dates, for the Fall of 2015 through the Spring of 2016.

FIG. 21 depicts, in tabular format, depth to performance characteristics for experimental pipe and diffuser.

FIG. 23 depicts, in tabular format, drawdown flow rate estimates for experimental diffuser, Apr. 18, 2016.

FIG. 29 depicts, in tabular format, estimates of water surface area and water volume of a containment pond at different water levels.

DETAILED DESCRIPTION OF BACKGROUND AND RESEARCH RESULTS

Figure 1:
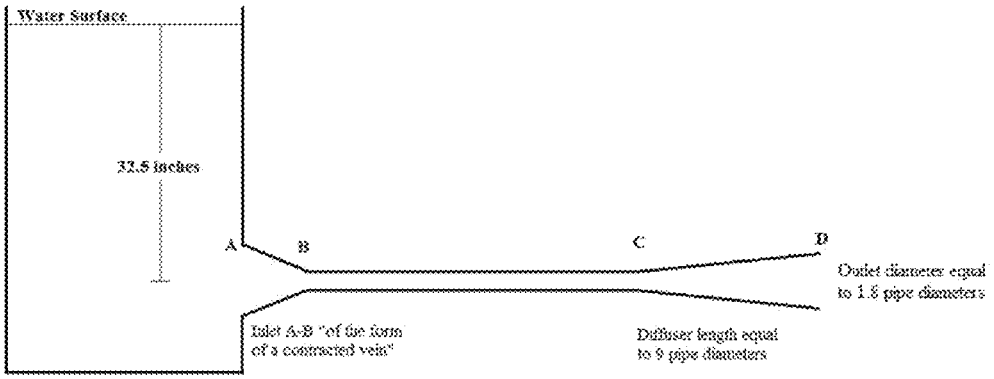
FIG. 1 depicts a the relationship between the increased flow rate from a flared inlet to a pipe and the relationship between the increased flow rate from a flared outlet, as originally posited by Giovani Batista Venturi.

Water flow capacity within a straight pipe, such as a traditional culvert, is subject to capacity loss, or more precisely loss of total throughput of volume per unit time. These losses occur at the entrance to the pipe and at the outlet of the pipe. Typically, entrance losses and friction losses each constitute approximately one quarter of the total losses in a culvert, and outlet losses account for the remaining half (Bauer, 1959, p. 53). A significant amount of research has been focused on inlet design. Comparatively little research has been directed toward reducing outlet losses because of a commonly held belief that little can be done to improve outlet efficiency. However, in their review of literature related to culvert hydraulics, Larson and Morris of St. Anthony Falls Hydraulic Laboratory came to the following conclusion regarding the reduction of outlet losses through the use of diffusers:

> "In submerged culverts of uniform bore, outlet loss often is the largest head loss, particularly if the culvert is relatively short. Therefore, reduction of outlet loss, if possible, can be expected to produce a substantial increase in capacity. If the outlet is completely submerged, the capacity of a culvert can be increased by an enclosed, diverging outlet section, which reduces the outlet velocity and thereby the kinetic energy lost at the outlet. In the Iowa tests [by Yarnell, 1926, p. 15], flared outlets were used with both pipe and box culverts and were found to produce capacity increases up to 60 percent." (Larson and Morris, 1948, p. 14)

The ability to increase the capacity of existing pipes, rather than replacing them, has substantial advantages. Replacing pipes, especially in deep fills, urban areas, and high traffic areas, has significant construction costs, as well as costs related to traffic disruption. Slip-lining, the process of relining a pipe and injecting grout to fill any voids and secure the liner in place, is an inexpensive way to repair existing pipes. However, slip-liners reduce pipe diameter and therefore pipe capacity. Bell inlets, for example Hydro-Bell by Snap-Tite, are used by slip-liner companies to partially compensate for this reduced capacity. The combination of both a bell inlet and a flared diffuser outlet would be far more effective at increasing the pipe capacity of slip-lined pipes. Similarly, the capacity of undersized pipes could be increased without major construction costs by the addition of a diffuser at the outlet and an improved inlet.

Increasing rainfall intensities associated with changing weather patterns are placing a higher demand on existing culverts, leading to more undersized pipes. The aging highway infrastructure and increased peak flows from both weather and development make rehabilitation of existing pipes particularly attractive. In addition, the reduced outlet velocity associated with diffuser outlets would help to minimize outlet scour that often accompanies undersized pipes.

Herein is summarized the results of research related to outlet diffusers, done under the auspices of a Maine DOT Research Grant supported by Federal Highway Administration (FHWA). The first section provides a brief summary of what is known about diffuser design and function. During the initial research phase, Computational Fluid Dynamics (CFD) computer modeling was used to explore diffuser design and function. The second section summarizes the results of this study. During the literature review, questions arose regarding the effect that different materials would have on diffuser function. Two diffuser models were constructed and subsequently tested at the University of Maine Hydraulics Lab flume. The third section briefly presents the results of these tests. The fourth section summarizes results of field tests of an oval fiberglass diffuser attached to the local pipe mentioned above. This 15 inch pipe was regularly observed to be under pressure flow, with water overtopping the road several times a year. The site had been monitored for both rainfall and water depth for 3 years prior to the installation of the diffuser. The final section discusses opportunities for future research, including the proposed addition of diffuser outlets to several existing pipes in the state of Maine that are known to be undersized or in need of repair.

To gain understanding and background on the concept of diffuser outlets, an extensive literature search was conducted. Many papers and references were reviewed covering the basic physics of diffusers, and how inlet and outlet geometries affect diffuser function and efficiency. A brief summary of this material is included below.

The first extensive testing of outlet diffusers was performed in the late 1700s by Giovani Batista Venturi. A brilliant researcher, Venturi designed and tested optimal geometries for diffuser outlets and flared inlets. To test his designs, he measured the amount of time it took for a fixed amount of water to pass through a fixed aperture with various attached pipe systems. He expressed his results in terms of ratios, comparing the results from modified pipe systems to those of the simple aperture. See FIG. 1.

To summarize Venturi's results, the addition of a flared inlet improved performance by 21% over the simple aperture. The addition of the flared outlet to the flared inlet improved performance by 98% over the flared inlet alone. The combination of the inlet and the outlet improved performance by 140% over the simple aperture (Tredgold, 1862, p. 154).

Figure 2:
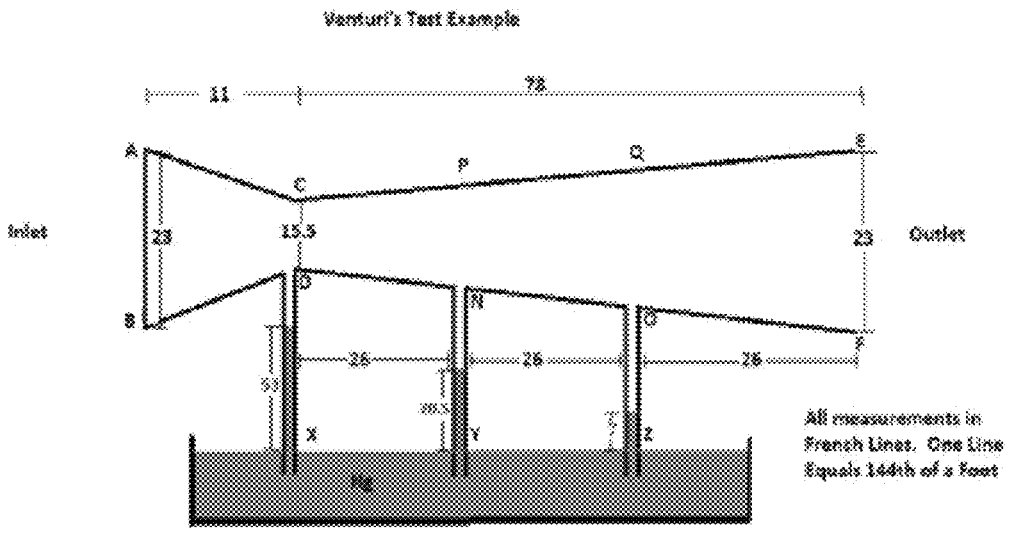
FIG. 2 depicts a schematic rendition of Venturi's test rig for determining pressures within a fluid flow.

In further experiments, Venturi attached a conical inlet to a conical outlet. He attached three glass tubes (early versions of piezometers) to the diffuser, one at the throat of the diffuser, one a third of the way through the diffuser, and one two thirds of the way through the diffuser. As illustrated in FIG. 2, the lower ends of the tubes were placed in a reservoir of mercury (Tredgold, 1862, p. 146). When water flowed through the device, mercury rose to varying degrees in the three tubes, indicating a strong negative pressure. As shown in FIG. 2, the negative pressure is strongest at the throat of the diffuser, and progressively decreases in the two subsequent tubes. Although Venturi didn't use this terminology, his tests were the first known confirmation of the vacuum created by a diffuser. This vacuum appears to be central to increasing capacity and decreasing losses in the diffuser systems.

In 1887, Clemens Herschel used Venturi's combination of a flared inlet and a flared diffuser outlet to create the "Venturi Meter". When the Meter was inserted in a large pipe, measurements of the difference between the upstream pressure and the diffuser throat pressure allowed Herschel to accurately measure the flow rate in the pipe.

Herschel's primary interest was in being able to measure flow rates, not in being able to increase pipe capacity. However, the results of his Venturi Meter tests nonetheless indicate the effect of diffusers on pipe capacity. Herschel worked with two Venturis, one with a nine foot diameter pipe and a three foot diameter throat, and one with a one foot diameter pipe and a one-third foot diameter throat. In both cases, at high flows, the flow of water through the Venturi was 98% as efficient as through the pipe without the Venturi. In other words, at a given pressure, the diffuser allowed 98% as much water to flow through a three foot diameter opening as was able to flow through the nine foot diameter straight pipe. As flow rates decreased, the efficiency of the Venturi Meter and the accuracy of the measurements of flow decreased (Herschel, 1898, p. 36).

In the 1920s, David Yarnell did the first research and experimentation on the possible use of diffusers in highway applications. Yarnell, a drainage engineer with the Bureau of Public Roads, was asked to conduct a study on the hydraulics of culverts. He experimented with many different inlets and outlets at the University of Iowa. The increased flow rate which resulted from the use of diffusers, "increasers" in his terminology, led him to experiment with a number of diffuser geometries. This remains the largest set of data on the design of diffusers for highway culverts (Yarnell, 1926, pp. 105-106). Yarnell tested both a conical diffuser attached to a round vitrified clay pipe (VCP) and a number of flared rectangular diffusers attached to square box culverts. A meticulous researcher, he was able to record and process massive amounts of data, including flow rates and piezometer readings along the length of pipes and diffusers.

Figure 3:
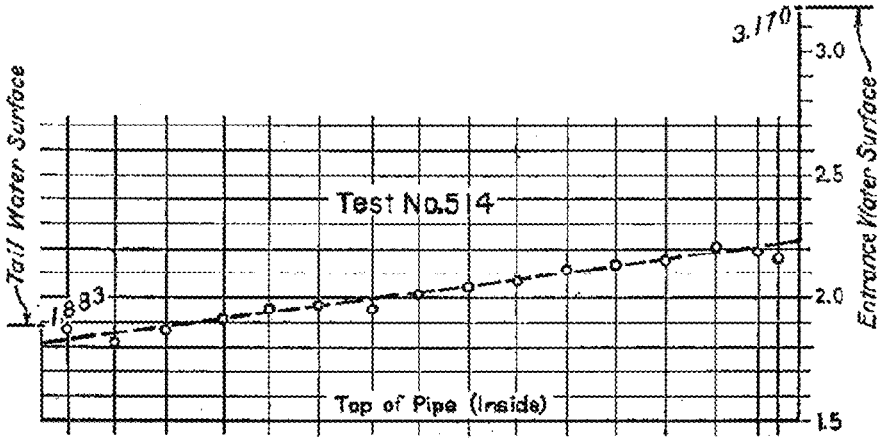
FIG. 3 depicts, in graphical format, the hydraulic gradient for a straight pipe, as tested by Yarnell (1926).

FIG. 3 illustrates Yarnell's hydraulic grade line (HGL) for a straight pipe. Piezometer readings along the length of the pipe are depicted as small circles. Pressure decreases consistently from the entrance, on the right, to the outlet, on the left. The hydraulic gradient is above the pipe for the entire length, and is the result of the raised outlet weir which maintains submergence of the pipe. This forces the pipe to operate under pressure flow and outlet control.

Figure 4:
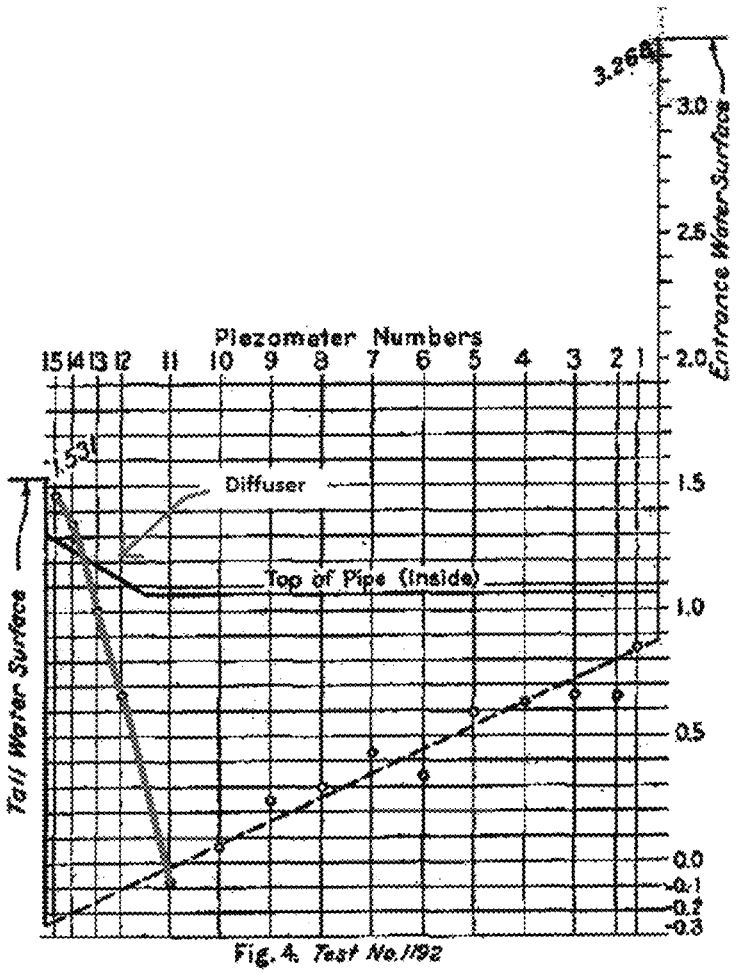
FIG. 4 depicts, in graphical format, the hydraulic gradient for a pipe with diffuser outlet, as tested by Yarnell (1926).

In contrast, FIG. 4 illustrates the HGL of a pipe with a diffuser outlet. The small circles again depict the measured piezometer readings. The pressure decreases consistently and steeply from the entrance of the pipe on the right to the entrance of the diffuser, at piezometer 11. In this pipe section, all of the piezometer readings are shown below the top of the pipe, indicating that a vacuum is created by the diffuser and extends upstream from the entrance of the diffuser to the pipe inlet. The piezometer readings from 11 to 15 increase rapidly, reaching atmospheric pressure at the submerged outlet. This represents the recovery of pressure head in the diffuser. Note, in FIG. 4, the line to the left shows the pressure recovery in the diffuser outlet. This increasing pressure gradient opposes the flow and is therefore considered an adverse pressure gradient, which contributes to the decrease in outlet velocity. The vacuum generated at the entrance of the diffuser increases the hydraulic gradient from the culvert inlet to the entrance of the diffuser, and represents a second force, in addition to the inlet head, acting on the water and increasing the flow in the pipe.

The contrast between these FIGS. 3 and 4 is striking. Both pipe systems have similar inlet and outlet water levels and are under pressure flow. However, the difference between the HGL in the two systems illustrates the effects of adding a diffuser. The HGL in the pipe with the diffuser clearly demonstrates both the creation of the vacuum and the recovery of head. With the diffuser, the effective pressure head is the difference between the pressure created by the inlet water level and the pressure at the throat of the diffuser, 3.27'−(−0.09')=3.36'. Without the diffuser, the effective head is the pressure created by the inlet water level minus the low pressure reading just before the outlet, 3.17'−1.82'=1.29'. This major difference in effective head is the result of the vacuum created by the diffuser and accounts for the increase in capacity.

Yarnell summarized the effects of a diffuser on the capacity of a box culvert as follows:

"If the outlet end of a 36-foot box culvert with a rounded lip entrance is flared by diverging the sides at an angle 6°30' throughout a distance of 10 to 12 feet from the outlet headwall, thus doubling the area of its cross-section at the outlet, the capacity of the culvert is increased about 60 percent above the capacity of a similar pipe with a uniform bore extending the entire length of the culvert." Yarnell (1926, p. 15)

Figure 5:
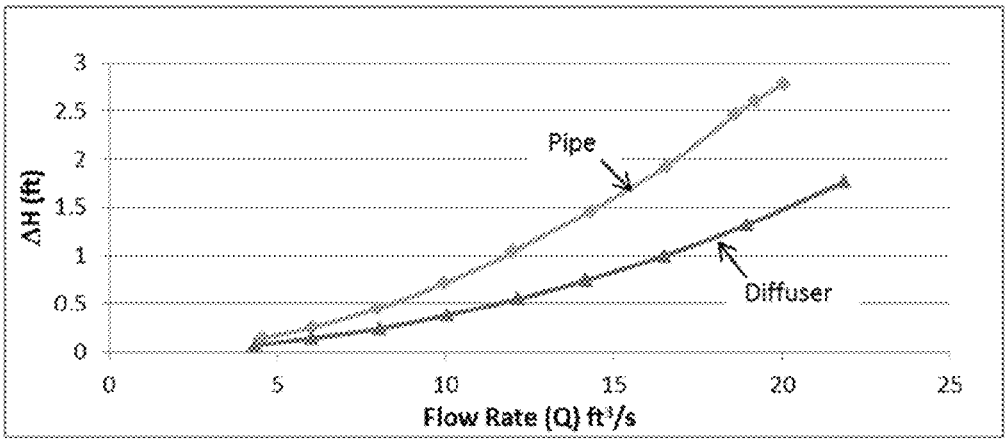
FIG. 5 depicts, in graphical format, a comparison of performance curves for an 18" VCP and an 18" VCP with a diffuser (Yarnell in 1926).

In the round VCP, Yarnell found a 40% increase in flow rate with the addition of a conical diffuser outlet in comparison with a straight pipe. (Yarnell, 1926, p. 13) FIG. 5 presents performance curves for an 18" VCP with and without a diffuser based on Yarnell's data.

The range in increased capacity from 40% found in the vitrified clay pipe to 60% found in the box culvert reflects the range in performance that can be expected with the addition of an efficient diffuser with improved inlet and outlet conditions (Yarnell, 1926).

Concurrent with Yarnell's work, Julian Hinds did extensive work with the use of diffusers (siphon outlets in his terminology) in aqueducts. His focus was primarily on reducing head losses in order to maintain flow over long distances. Hinds documented the use of flared transitions from diffusers into open channels. This resulted in extremely low outlet losses that Hinds recorded (Hinds, 1927, p. 1452)

It is noteworthy that the flare in the open channel had an impact on overall performance. In the context of this current project, the implication is that although the diffuser needs to be full to create a vacuum and be fully functional, some benefit is still derived when the diffuser is not full and functions as an efficient channel transition from a narrow pipe to a wider channel.

Comparison of pipes of various sizes requires a method of eliminating the variation created by scale. To do this, the following dimensionless relations are defined:

$$Q^*=Q/(2\ g)^{0.5}D^{2.5} \quad (1)$$

$$H^*=\Delta H/D \quad (2)$$

In these equations, Q is the flow rate, Q* is the dimensionless flow rate, D is the pipe diameter, ΔH is the change in head, defined as the difference between inlet and outlet water surfaces, and ΔH* is the dimensionless head.

Pipes operate under inlet control, barrel control, or outlet control. When inlet losses are high, resulting from poor inlet geometry, the inlet is the limiting factor in that the inlet cannot accept as much flow as the barrel can convey. The pipe does not completely fill, and is said to be under inlet control. In inlet control situations, the head is defined as the height of water above the inlet invert, or headwater ($H_W$).

Under barrel control, the barrel cannot move as much water as the inlet can deliver and the outlet can accept because of friction losses, the flow in the culvert is subcritical. In highway applications, the pipe does not typically run completely full, and the outlet is not submerged. In this case, the head is defined as the difference between the inlet water level and the water level in the pipe ($H_p$) at the outlet, $H_W-H_p=\Delta H_{(BC)}$.

Under outlet control, the inlet and the outlet are both submerged, and the pipe is full and under pressure flow for the entire length. In this case, the head is defined as the difference between the inlet water level and the tail-water level, $H_W-T_W=\Delta H_{(OC)}$.

Note that ΔH is used for both outlet and barrel control. This is because most sources (including the standard reference HDS 5) do not differentiate between the two, referring to both as outlet control. For a given $H_W$, the difference is that in barrel control, the pipe length and friction are the limiting factor, whereas in outlet control, the Tail-water level is the limiting factor.

With the addition of an outlet weir to fully submerge the outlet, pipes under either barrel control or outlet control would be candidates for the addition of a diffuser. (See HDS 4, 2001, pp. 136-141, and HDS 5 pp. 3.22-3.40 for more details on Inlet and Outlet Control and Skogerboe and Markley (1996) for details on Barrel Control).

For a diffuser to work in a given situation, certain site conditions, as well as design requirements for the inlet and the diffuser outlet, must be met. First, the pipe and the diffuser must be full to be fully effective. This requires adequate cover above the pipe. Typically a water depth of 1.5 pipe diameters (1.5D) above the bottom of the pipe is required to fill a pipe, with at least 1.6D required to fill the diffuser as well. In other words, to obtain the full benefit from the diffuser, there must be adequate cover over the pipe to allow the required depth of water at the culvert inlet.

Figure 28:
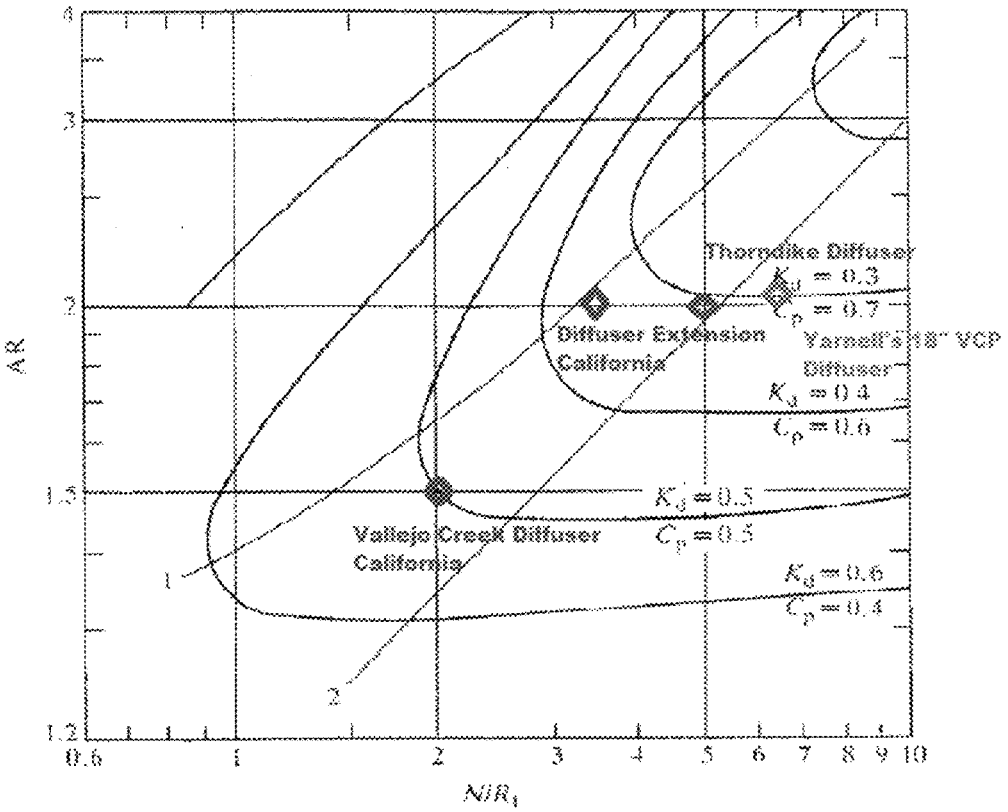
FIG. 28 depicts, in graphical format, dimensionless diffuser performance efficiency, for free discharge diffusers (Miller 1990).
Figure 30A:
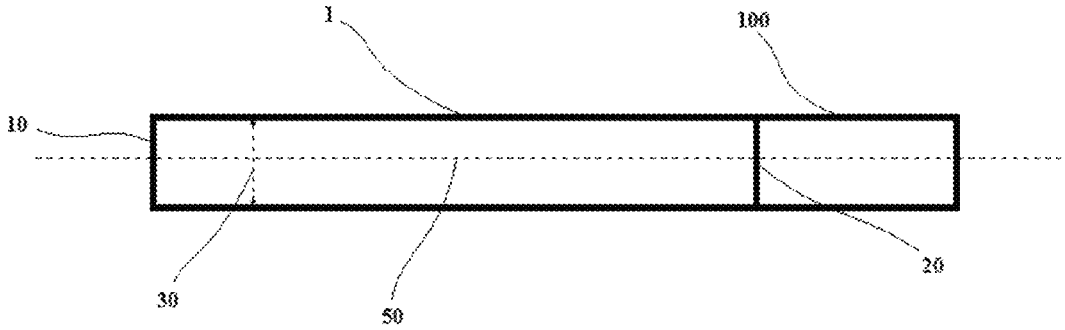
FIG. 30A depicts a plan side view of one embodiment of the diffuser of the present invention attached to a culvert.
Figure 30B:
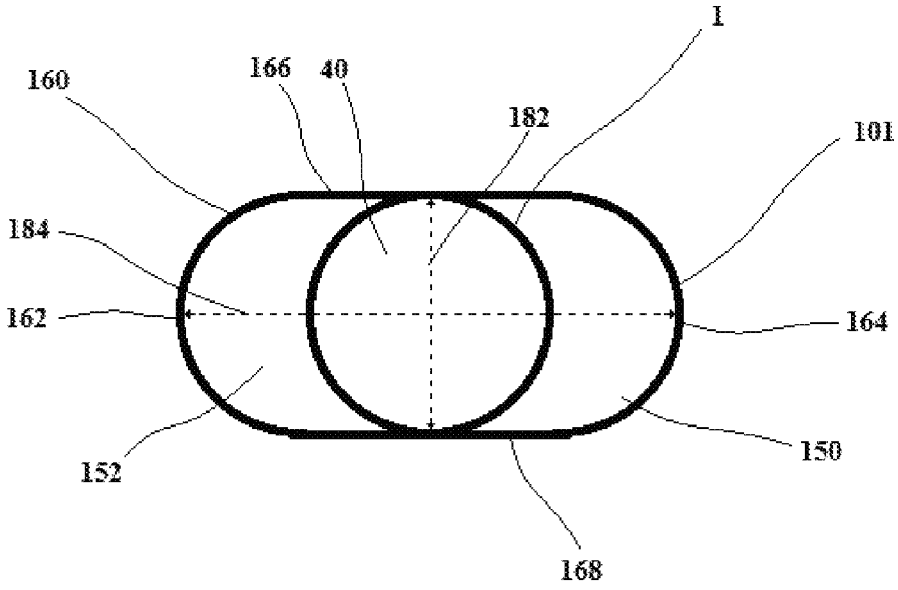
FIG. 30B depicts a plan front view of the embodiment of the diffuser of the present invention shown in FIG. 30A.
Figure 30C:
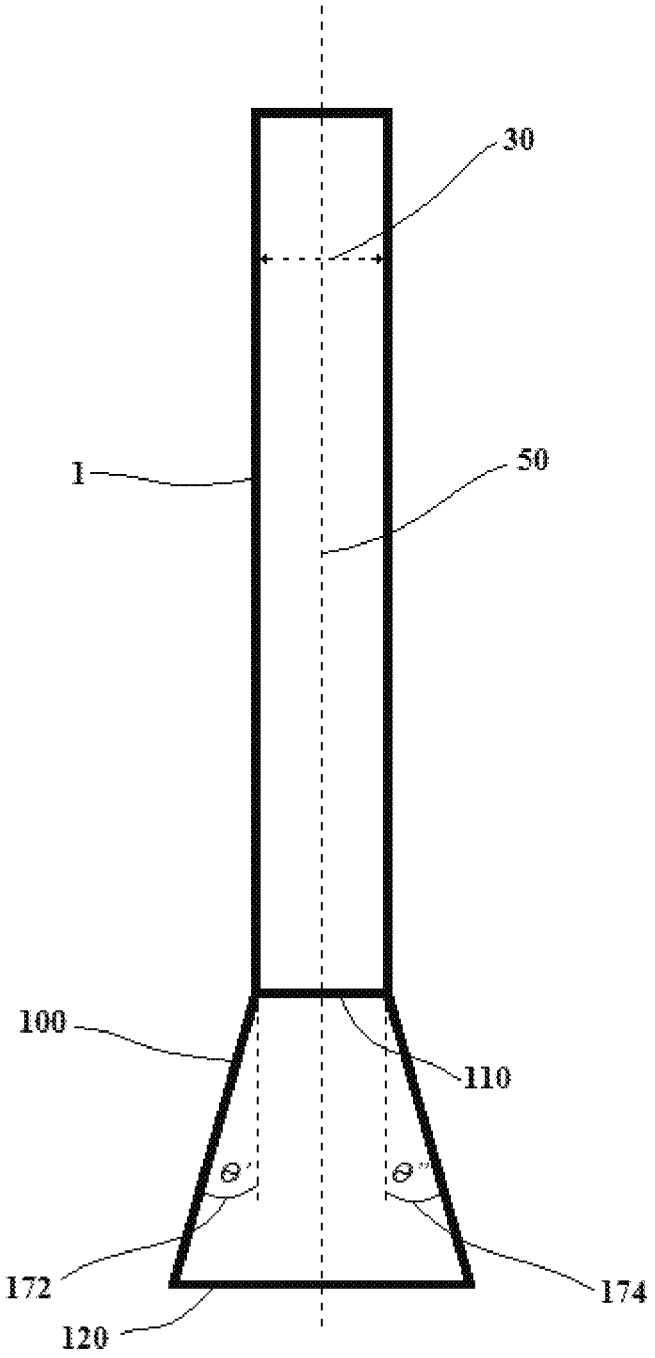
FIG. 30C depicts a plan top view of the embodiment of the diffuser of the present invention shown in FIGS. 30A and 30B.
Figure 30D:
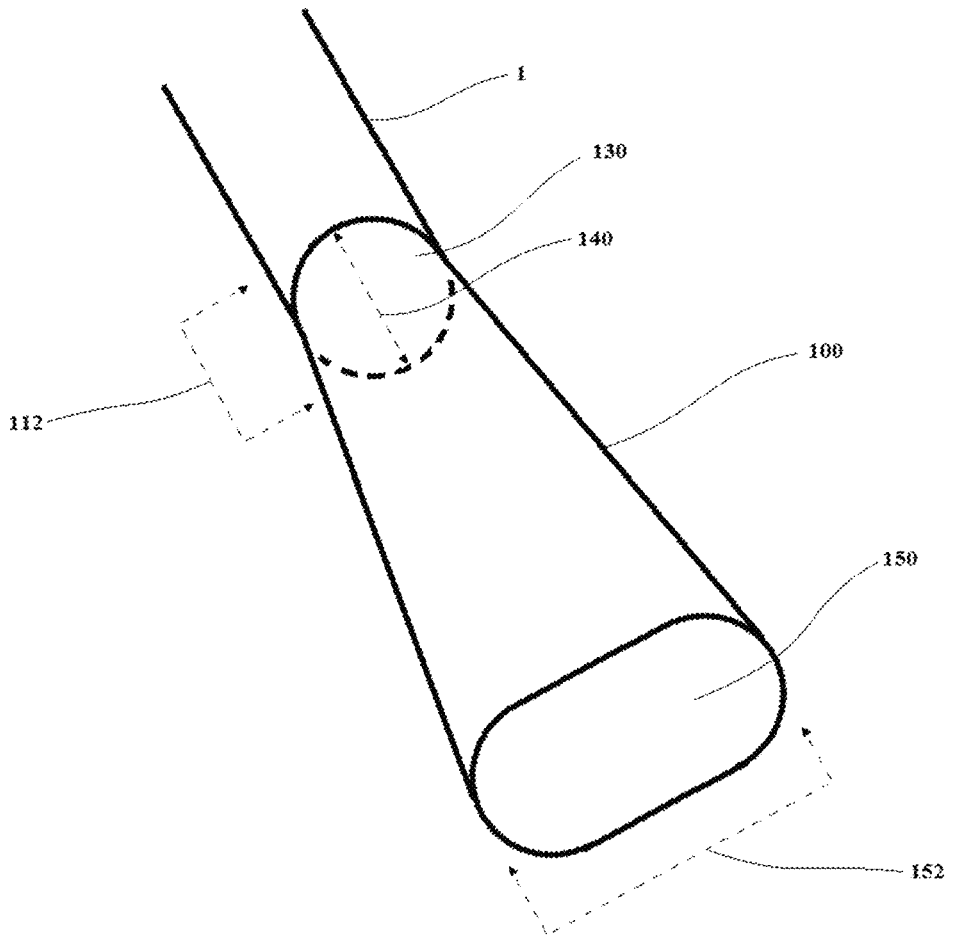
FIG. 30D depicts a perspective top view of the embodiment of the diffuser of the present invention shown in FIGS. 30A, 30B, and 30C.
Figure 31:
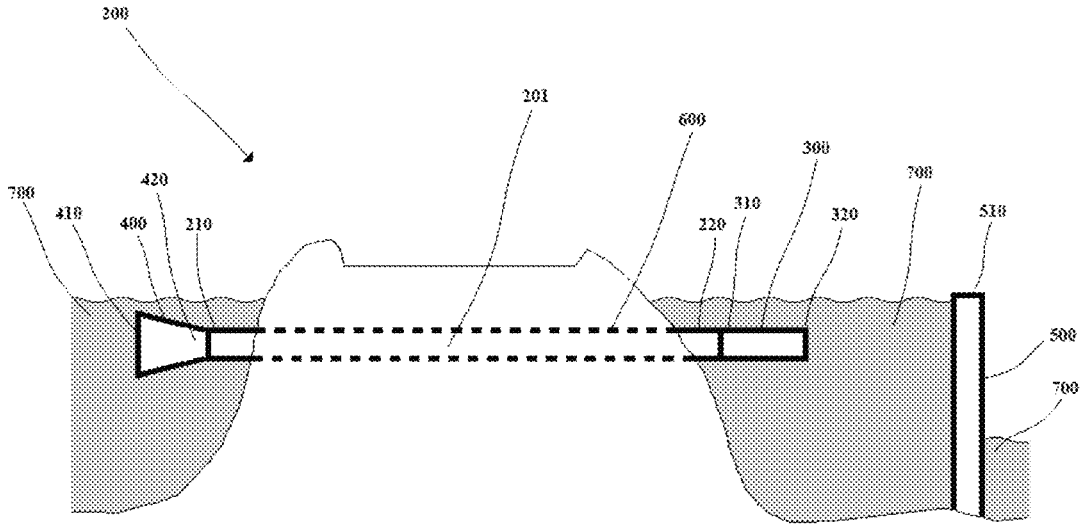
FIG. 31 depicts a schematic side view of an embodiment of the culvert diffuser system of the present invention, with the culvert pipe passing through an embankment having a roadbed on top, with ponded water on either side of the embankment and on either side of a weir.

In addition, improved inlets reduce inlet losses, further contributing to the filling of pipes. Improved inlets commonly used are bell inlets and tapered inlets. In some situations, inlets with overhanging projections, known as hooded inlets, have been shown to both facilitate the filling of pipes at low inlet heads and prevent vortices from forming at the inlet (Rouse, 1959, Blaisdell, 1958, pp. 38-39). Bell inlets and tapered inlets have an additional advantage in that they help to establish symmetric flow in pipes, and therefore diffusers. Symmetric flow is important for diffuser functioning. (See FIG. 28 for a representation of symmetric flow in diffusers.)

Figure 6:
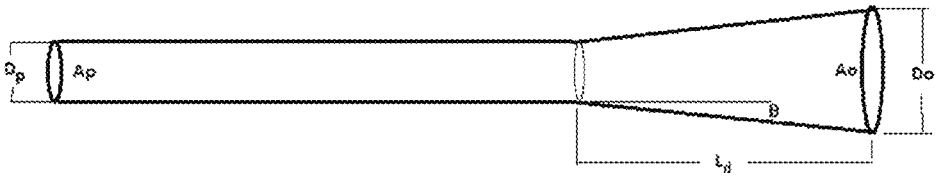
FIG. 6 depicts a schematic side view of a pipe with an outlet diffuser, showing the geometric relationships related to diffuser outlets.

There are two fundamental geometric variables in diffuser design: flare angle and area ratio $A_R$. Diffuser flare angle is the crucial variable in diffuser design. Flare angle can be expressed as either a half flare angle θ or as a total flare angle 2θ. Area ratio is defined as the ratio of the diffuser outlet area to the pipe area, $A_R=A_O/A_P$. Given θ, either an area ratio or a diffuser length ($L_d$) must be included to fully define the diffuser outlet geometry. These geometric relationships are illustrated in FIG. 6.

In 1912, Gibson performed extensive tests exploring diffuser function at the University College, in Dundee, England. His research indicated that for a conical diffuser on either a round or a square pipe, 6° was an optimal total flare angle (3° half flare angle). With a rectangular diffuser with the two vertical sides flaring, the optimal total flare angle was found to be 10° to 12° (5° to 6° half flare angle) (Larson & Morris, 1948, pp. 118-120).

In 1950, Venegas also investigated optimal flare angles in rectangular diffusers, obtaining similar results to Gibson's. One of his models was used as the basis for the models tested at the University of Maine flume as part of this current research, and reported in the third section of this paper.

It is instructive that the optimal flare angle of a diffuser closely approximates the natural expansion of water exiting a pipe. The mechanical confinement of the water by the diffuser forces the flow into contact with the diffuser wall, a necessary condition for attachment. This natural expansion is a limiting factor: as the angle exceeds this expansion, the water exiting the pipe and entering the diffuser will not follow and remain attached to the diffuser wall, a condition necessary for the diffuser to function. Without this attachment, the vacuum will not be established, the flow will not increase, the outlet velocity will not decrease and outlet losses will remain high. It is safer to err in the direction of a smaller flare angle rather than a larger flare angle, as the latter will not perform reliably.

The last important design consideration that allows the pipe and diffuser to be full and functional is submergence of the outlet. This can be accomplished by the construction of an outlet weir. The location of the weir would be dependent on site conditions, but would ideally be at least 1.5 diffuser lengths from the outlet of the diffuser. Ideally an outlet weir would be high enough to allow water to pool to the top of the diffuser. The weir height would be matched to a design flow, so that the diffuser would activate at that flow. A diffuser that flares horizontally, rather than vertically, will allow for the use of a lower outlet weir. The flow that causes the inlet pond to reach 1.6 pipe diameters would be the height at which the diffuser would ordinarily activate. This would be a logical design flow for the outlet weir. This is an area for further research. Although this is a higher inlet water level than would be acceptable for most new pipe installations, for a retrofit, repair, or a pipe with size limitations this could provide a reasonable solution.

In summary, adequate cover to provide adequate head at the inlet, an improved inlet, symmetric inlet flow, a properly flared diffuser, and submergence of the diffuser outlet are all necessary design factors for a functional diffuser.

In the February 1943 edition of *California Highways and Public Works*, a brief article reported the construction of a "flare-siphon culvert", or diffuser, at Vallejo Creek.

Subsequently a flared extension was added to a second culvert. The fact that this type of design did not continue to be used suggests that the culverts did not meet expectations. However, it is clear from the description of the diffusers that the necessary design requirements listed above were not met. No mention was made of the use of improved inlets or outlet weirs for either design. The Vallejo Creek culvert was constructed as a three-cell box culvert. The flare angle of the diffuser on the central cell was 14.25°, which is well above the optimal angle. The outer flare angle in the two outer cells was 20.56°, with a bend at the diffuser inlet creating asymmetric flow. Both the bend and the flare angle were not conducive to effective performance of these two cells. In addition, the amount of cover at the culvert site was 1.375D above the bottom of the culvert, which would not allow adequate head for the diffuser to function.

In the second culvert, the total flare angle was 17.1° (8.55° half flare angle), again well above optimal. The flare angles for both culverts were in line with design recommendations from the "California Culvert Practice" (1955), which states "The flare angle tangent "t" should not exceed 0.2 [11.3° half flare angle or 22.6° total flare angle] for moderate velocities or 0.1 [5.7° half flare angle or 11.4° total flare angle] for high velocities, or the diverging jet will not wet the outer walls (causing a gurgling turbulence as prime is intermittently lost)." (California Culvert Practice, 1944, pp. 53-55). Although there is an acknowledgement of the importance of the vacuum, or "prime", based on the consensus of the literature, the suggested 11.3° half flare angle is considerably too wide to be effective.

In addition, although it appears that adequate cover over the pipe was present, the apparent lack of an outlet weir made it unlikely that the pipe was submerged. Despite these design issues, the California Division of Highways reported a 20% increase in capacity as a result of the addition of the diffuser (California Culvert Practice, 1955, p. 75).

The apparent failure of these two culverts to perform as well as hoped probably discouraged further research and funding of diffuser outlets. In addition, two sources of information regarding hydraulics and culvert design also dampened interest. In 1959, Rouse, a prominent hydraulic engineer from the University of Iowa, co-authored the paper "Hydraulics of Box Culverts". It concluded:

> "Brief mention has been made of the custom of repeating the inlet shape at the outlet. Hydraulically this is of no use whatever, and it is doubtful whether more than a very gentle outlet flare would effectively reduce the erosive effect of the outflow." (Metzler and Rouse, 1959, pp. 28-29)

Metzler and Rouse's point that the flare angle used in inlets is not appropriate for outlet diffusers is valid. However, their downplaying of the effectiveness of a gradual flare on decreasing scour, and their failure to note the increase in flow associated with flared outlets, seems a bit surprising. Rouse was teaching at the same University of Iowa where Yarnell conducted research and provided a significant amount of data supporting the effectiveness of outlet diffusers at both increasing pipe capacity and reducing outlet velocity.

The most recent hydraulic FHWA culvert design manual, HDS 5 (Schall et al, 2012) briefly touched on the use of diffusers, citing the California 'flared-siphon' experience and the lack of further data:

> "A flared-siphon culvert has an outlet which diverges, much like a side-tapered inlet. The Venturi (expanding tube) principle is used to salvage a large part of the kinetic energy and thereby increase the culvert capacity. The State of California was experimenting with these designs in the early 1940-1950s. Obviously, submergence of the outlet is necessary to achieve the siphoning action. Presumably, the added capacity was not dependable, and their design is rare." (Schall, et al, 2012, p. 5.6).

Unfortunately, the California experiments were based on problematic designs, and negative conclusions based on their results have discouraged further research. Because diffusers have specific requirements, they must be carefully designed. The lack of research and data regarding the design and use of diffuser outlets with highway culverts, the effective use of diffusers in other industries and applications, and the large potential benefits of rehabilitating existing culverts to maximize flows and minimize erosion, indicate that further experimentation with field applications, as well as a deeper understanding of the physics of diffuser functioning, would be merited.

Discussion of diffuser function requires an understanding of outlet losses and some of the basic equations related to these losses. Traditionally, in highway design, the velocity of water leaving a pipe represents "lost energy", with the loss of kinetic energy expressed as an outlet head loss:

$$H_o = K_o V_p^2 / 2\,g \quad K_o = 1 \tag{3}$$

In this equation, $H_o$ is the outlet head loss, $V_p$ is the velocity of the water in the pipe, g is the gravity constant, and $K_o$, is the outlet loss coefficient, which is typically assigned a value of 1. Tullis (2012) reported results from lab experiments measuring outlet losses and associated loss coefficients. He used his results to assess the accuracy of various equations used to calculate outlet head loss. He found that at high flow rates, Equation 3 overestimated head losses by up to 187% (Tullis, 2012, p. 26).

The second and slightly improved method for calculating $H_o$ is found by subtracting the velocity head in the downstream channel from the pipe's velocity head. In practice, an estimate of the downstream velocity ($V_d$) is used to calculate the outlet head loss (Larson and Morris, 1948, p. 48).

$$H_o=K_o(V_p^2-V_d^2)/2\text{ g } K_o=1 \quad (4)$$

At high flow rates, Tullis found this equation overestimated losses by as much as 143% (Tullis, 2012, p. 26).

The third equation is the Borda-Carnot Equation, originally derived to be used for abrupt expansions in pipe systems, and subsequently used to calculate diffuser losses (Gibson 1912, pp. 205-206, Larson and Morris, 1948, p. 48, Tullis, 2012, p. 26):

$$H_o=K_o(V_p-V_d)^2/2\text{ g, } K_o=\alpha(\text{typically 1})$$

$$\text{or } H_o=K_oV_p^2/2\text{ g, } K_o=(1-A_p/A_d)^2 \quad (5)$$

In this equation, $A_p$ is the area of the pipe and $A_d$ is the area downstream of the outlet. The kinetic energy correction factor $\alpha$ is equated to the outlet loss coefficient $K_o$ (Larson & Morris, 1948, p. 14). For a pipe emptying into a channel, $A_d$ would be the area of the channel. In the case of a diffuser, $A_d$ would be the outlet of the diffuser. Note that $A_p/A_d=1/A_R$, the inverse of the area ratio $A_R$.

This equation proved to be much more accurate, with errors at high flow rates of only 6.2%. Rather than assuming $K_o=1$, the Borda-Carnot Equation bases its loss coefficient on the ratio of the pipe area to the outlet area. The Borda-Carnot Equation is derived from the combination of three equations: the Bernoulli Equation (the energy equation), the momentum equation, and the continuity equation (the mass-balance equation). (For a complete derivation of the Borda-Carnot Equation, see Tullis, 2012, p. 26, also see Larson and Morris, 1948, p. 48). HY8 uses equation 3 as the default method for calculating outlet losses and flow through a culvert. The Borda-Carnot Equation is referred to as the Utah State University (USU) equation and has been included in HY8 as an alternative method.

The Borda-Carnot Equation incorporates momentum into its derivation and is considered the most accurate formula for outlet head loss. This suggests that momentum is an important factor in outlet losses. A change in momentum in a diffuser, related to the change in velocity from the entrance of the diffuser to the outlet of the diffuser, indicates that an additional force is acting on the water in the diffuser. It seems reasonable to assume that the low pressure at the diffuser entrance serves as a suction force that increases the flow rate and decelerates the water in the diffuser. This results in a reduction of velocity (and hence momentum) in the diffuser, as well as higher flow rates and lower exit velocities. Additional research would be required to understand how the low pressure zone is created and its impact on diffuser function.

Miller (1990) presents a graph predicting diffuser loss coefficients based on area ratio and dimensionless length ratio. This is an interesting design tool. See FIG. 28.

In order to fully understand diffusers, it is important to explore the role of the boundary layer and its attachment in a diffuser pipe system. A boundary layer is a layer of fluid near a solid boundary, as in a pipe wall, that has zero velocity at the solid boundary surface, where it is attached. The importance of the attachment of the fluid to the pipe wall can best be understood by discussing what happens when it fails and the flow separates from the wall. In a zone of separated flow, the flow can reverse, creating eddies which push against the primary jet, constricting the area of the primary flow. In addition, the combination of the flow separation from the wall and the force created by the effect of eddies on the primary jet can cause the flow to oscillate in the pipe. Because of the importance of symmetric flow and a well-established boundary layer at the entrance of the diffuser, this oscillation has a major detrimental effect on the functioning of the diffuser. If the flow is oscillating, it will move from side to side in the diffuser, and the diffuser will not function in the way that it should (Miller, 1990, pp. 61-63, Kline, et al, 1959, p. 322).

In the boundary layer, the velocity increases rapidly from the wall to the edge of the primary jet. Just beyond the zone of attachment, there is a zone of laminar flow, followed by a zone of turbulence. This turbulence is generated from shear at the interface of the boundary layer and the primary flow, and has an important role in pipe systems that will be discussed below (Miller, 1990, p. 64, Kalinske, 1944, pp. 356-357, Senoo & Nishi, 1977, pp. 379-380).

Figure 7:
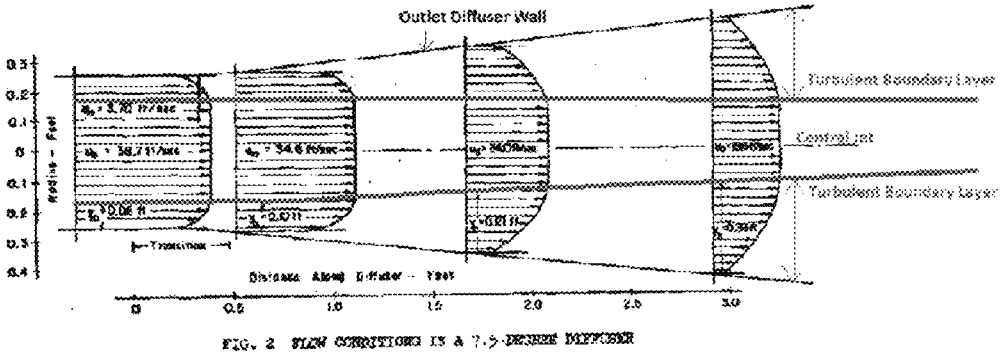
FIG. 7 depicts, in graphical format, the velocity and turbulent boundary layer in a diffuser.

It is well known that in an unimproved inlet, a vena contracta forms, a narrowing of flow just inside the inlet of the pipe, where the flow separates from the pipe wall, leaving the actual area of flow constricted in the central portion of the pipe and disrupting the boundary layer. If the pipe is long enough, more than 10 pipe diameters, the flow spreads, eventually filling the entire pipe, reattaching, and reestablishing the boundary layer. In contrast, a bell inlet allows the water to stay attached, developing a uniform velocity distribution and a thin, well-established boundary layer. As the flow enters the diffuser, the boundary layer thickens and the velocity distribution is altered (Larson & Morris, 1948, pp. 4-14). FIG. 7 shows the changing velocity distribution and the changing thickness of the boundary layer ($y_o$) as the flow passes though the diffuser.

Because the boundary layer is a turbulent low velocity zone, as it thickens, the average velocity in the diffuser decreases. This further contributes to the decrease in velocity that is the direct result of the widening of the diffuser, as required by the Continuity Equation. In addition, the shear between the primary flow and the boundary layer uses a significant amount of energy to create vortices which form on both sides of the shear interface. These vortices serve a number of important functions. They create a pressure on the boundary layer in the direction of the diffuser wall, helping to maintain its attachment. They transfer energy from the primary jet to the boundary layer, which helps to maintain both the boundary layer and its forward motion against the adverse pressure gradient (Miller, 1990, p. 61; Azad, 1990, p. 327; Senoo and Nishi, 1977, pp. 379-380). If the adverse pressure gradient stops the forward movement of the water in the boundary layer, and if the boundary layer does not remain attached to the diffuser wall, the flow separates from the wall, and little additional benefit is derived from the diffuser. The vortices in the central jet also create what is known as eddy viscosity, which further helps to slow the flow (Kalinske, 1944, p. 357, 374).

In summary, a well-designed pipe system will have symmetric flow entering a well-designed inlet that allows the water to attach to the wall and establish a thin and uniform boundary layer and stable flow. As the symmetric flow enters the properly flared diffuser, the boundary layer thickens, stabilizing and slowing the velocity in the central jet. The net result of this process is an increase in efficiency of the culvert system, with increased capacity and reduced outlet velocity. These design considerations can be illustrated graphically in CFD models. In addition CFD modeling can be used to pre-test designs of actual culvert systems, highlighting design flaws like those that prevented the California Highways flare-siphon culverts from functioning properly.

At the outset of this project, a connection was made with Kornel Kerenyi of the Turner-Fairbanks Highway Research Center, who was very supportive of this work and suggested utilizing Computational Fluid Dynamics (CFD) computer modeling as a way of exploring and understanding the design and function of outlet diffusers. The Transportation Research and Analysis Computing Center (TRACC) at Argonne National Lab located Chicago-West provided online access to the STAR-CCM+CFD program, as well as offering online tutorials and support. This CFD program has tools that facilitate the creation of models, which proved helpful in illustrating many of the design concepts involved with diffuser systems. However, obtaining a thorough understanding of the use of the CFD modeling takes time and practice, and this researcher is far from an expert.

Various inlets, inlet chambers, outlets and outlet chambers were modeled and tested at different flow rates. The inlet chambers in the CFD models attempt to represent the ponding of water in an inlet pool, the pressure head at the inlet, and the direction of flow entering the inlet. The outlet chambers in the models attempt to represent the water level in the outlet pool and the presence or absence of an outlet weir.

The CFD program presented the results graphically, using color coding to illustrate velocity and pressure gradients. Performance curves for each design could be created from the model data. Having this information presented visually was extremely helpful, supporting and extending the concepts encountered in the literature.

Figure 8:
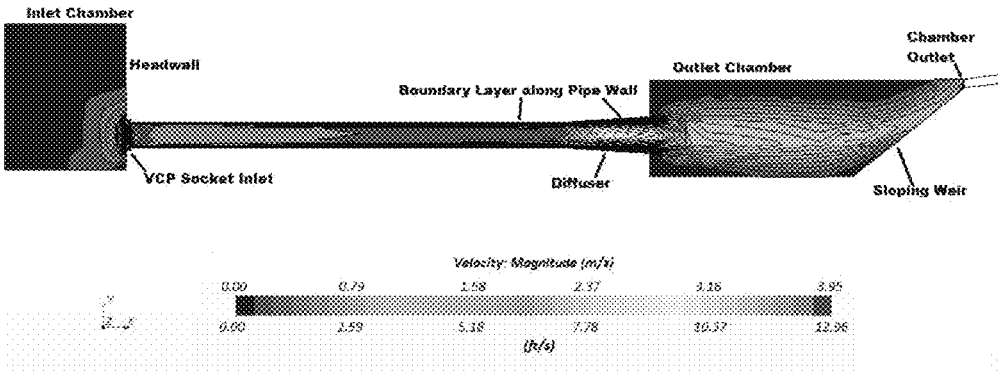
FIG. 8 depicts a CFD representation of Yarnell's VCP and Diffuser System.

FIG. 8 shows a CFD representation of Yarnell's 18" VCP with a diffuser outlet. The diffuser expands from 18" to 26" over a length of 5', creating a total flare angle 7.6° (3.8° half flare angle).

The color gradient increases from blue to red for velocity, as well as for pressure, in all CFD figures. This illustration depicts the velocity of the flow rapidly decreasing from a maximum (red) in the pipe to a minimum (light blue) as it passes through the diffuser, reducing the kinetic energy lost at the outlet. The flow continues to expand and decrease in velocity within the outlet chamber, further reducing the kinetic energy available to create scour related issues. The black area at the edge of the pipe is created by close contour lines and represents the high velocity gradient of the boundary layer. This layer thickens and remains symmetric along the length of the diffuser.

Figure 9:
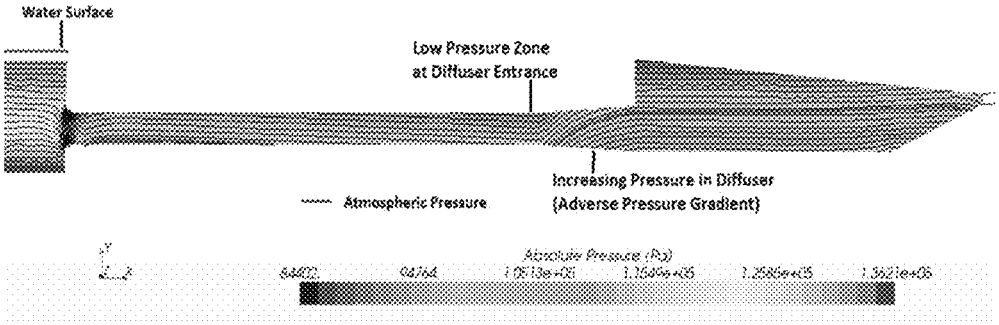
FIG. 9 depicts a CFD pressure diagram of Yarnell's VCP and Diffuser System.

In the CFD pressure diagram in FIG. 9, the low pressure zone at the entrance to the diffuser and the rapid increase in pressure through the diffuser are shown. The total effective head is the difference between the pressure at the inlet and the low pressure at the throat of the diffuser. This makes the effective head significantly higher than the difference between headwater and tail-water that drives flow in a straight pipe. The red line represents atmospheric pressure, indicating that almost the entire pipe is below atmospheric pressure. The low pressure, extending to the pipe inlet, increases the hydraulic gradient at the inlet which in turn increases the flow rate.

Figure 10:
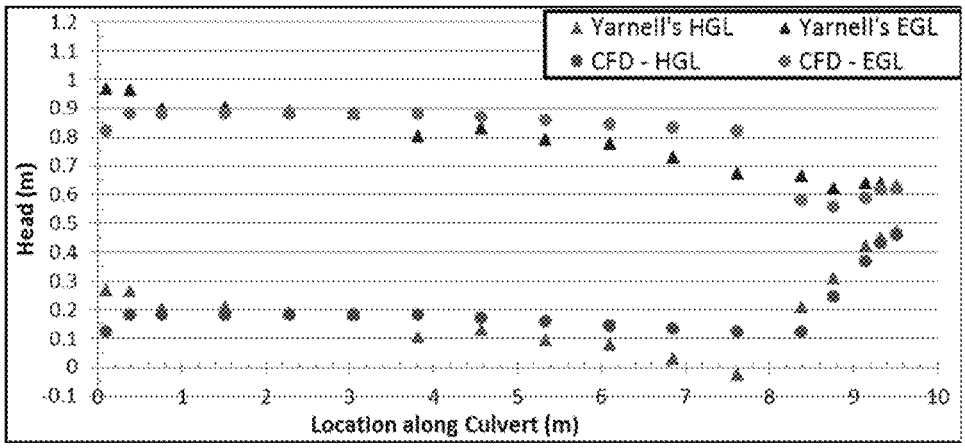
FIG. 10 depicts, in graphical format, HGL and EGL for Yarnell's 18" VCP and CFD model of Yarnell's VCP.

The pressure data from the piezometers in Yarnell's 18" VCP and the pressure data from the CFD model of this pipe (in FIG. 9) are plotted and compared in FIG. 10. The CFD model was not able to capture the full extent of the vacuum generated by Yarnell's diffuser as is shown in the two HGL curves. The energy grade line (EGL) was calculated for each of these models by combining the HGL values and the mean velocity head ($V^2/2$ g). The kinetic energy correction factor (a) was not calculated for either of these examples, which may account for the slight rise in the EGL of the CFD output data at the culvert inlet and diffuser outlet (see Larson and Morris, 1948, pp. 5-11 for a review).

Figure 11:
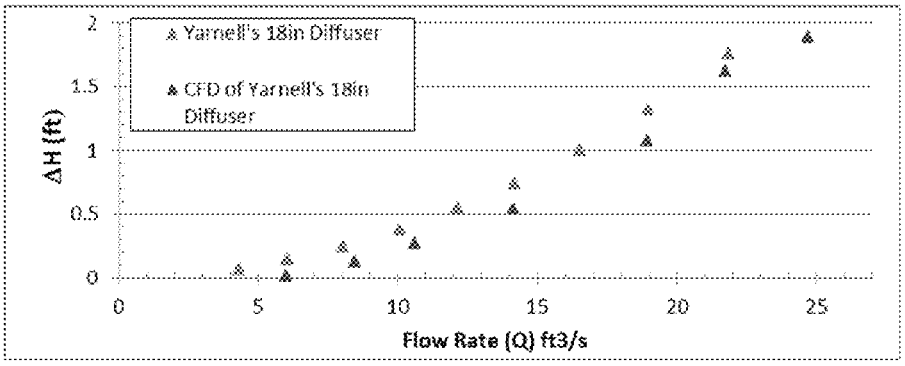
FIG. 11 depicts, in graphical format, the performance curve comparison of Yarnell's physical model and the CFD model.

FIG. 11 shows the performance curve created from the CFD model and the performance curve from Yarnell's original data. The two curves are similar, confirming the accuracy of CFD modeling. In the CFD model, ΔH was determined using inlet and outlet pressures, whereas Yarnell used inlet and outlet water levels. This could account for a portion of the shift in the data. Another portion of the shift could be related to a number of fluid dynamics characteristics that are difficult to duplicate with CFD modeling. The way turbulence, adhesive properties of the diffuser wall, and pipe roughness interact in a CFD model may be slightly different from a physical model. These factors could influence the efficiency of the CFD diffuser.

Figure 12:
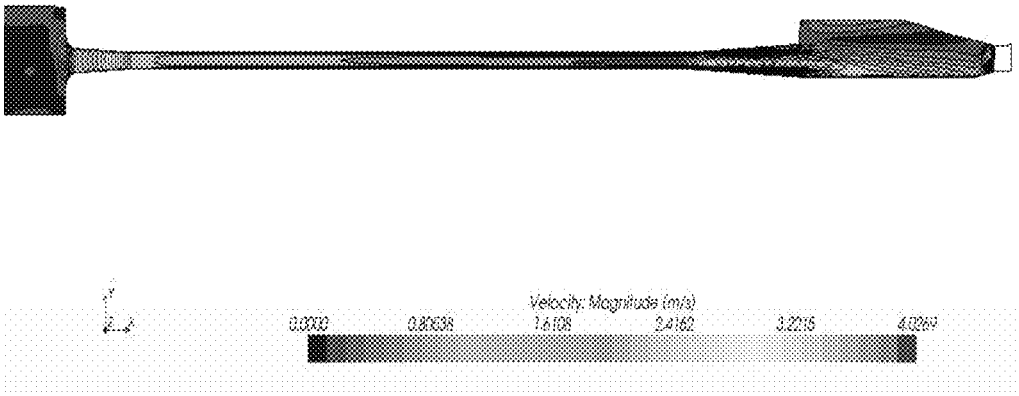
FIG. 12 depicts a CFD representation of an improved diffuser system with a Bell and tapered inlet and a diffuser with a high $A_R$.

In the CFD model in FIG. 12, an efficient bell and taper inlet and a longer diffuser with a higher area ratio was tested. This diffuser had an $A_R$ of 4 and a total flare angle of 5.72° (2.86° half flare angle).

Figure 13:
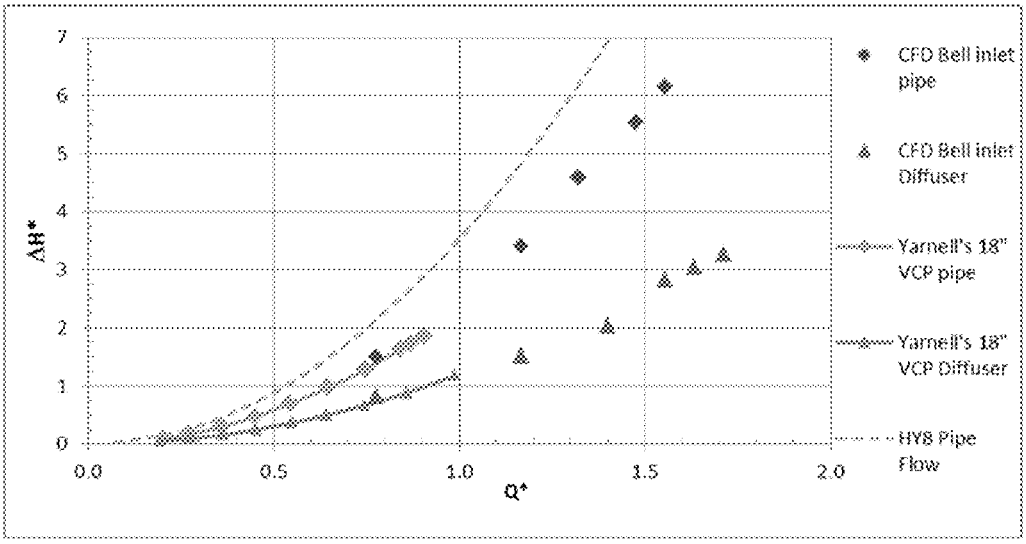
FIG. 13 depicts, in graphical format, the performance curves for CFD and Yarnell's diffuser data compared to pipe performance.

The combination of the improved inlet and diffuser outlet performed well, as noted in Venturi's early paper. FIG. 13 compares this CFD model, a CFD pipe without a diffuser, Yarnell's 18" pipe with a diffuser outlet, and Yarnell's 24" straight pipe. The graph uses dimensionless performance curves, allowing comparison of pipes of different diameters at different heads.

A performance curve generated from calculations made using HY8, a computer program created by Federal Highways to analyze culvert hydraulics, is also shown above. Since the default option for HY8 utilizes the velocity head (equation 3) to calculate outlet losses, the calculated performance is significantly lower than the performance measured using Yarnell's pipe data, as well as the CFD pipe data.

In this graph, the CFD pipe data lines up with Yarnell's pipe data and the CFD diffuser data lines up with Yarnell's diffuser data. This reconfirms the efficacy of CFD modeling. The diffuser curves are considerably to the right of the pipe curves, demonstrating the increased capacity of pipes with diffusers. This graph also clearly indicates that the effect of the diffuser on performance increases with higher heads, as the curves diverge as head increases.

CFD modeling supported and extended the concepts and information that was found in the literature, and confirmed that diffusers could be used to advantage in highway culverts. However, physical modeling is also necessary to confirm and better understand concepts alluded to in the literature. The role of the attachment of the boundary layer to the culvert surface is one such concept.

In *Hydraulics of Box Culverts* Metzler and Rouse (1959) noted that coating a culvert surface with hydrophobic materials such as wax or grease adversely affects the performance of the culvert. In addition, the separation of water from the top of the culvert at the outlet could be shifted upstream by coating the culvert with grease (hydrophobic), or downstream by coating the culvert with a wetting agent (hydrophilic). The effect of using tallow or wax on the flow of fluid through a pipe is also addressed in *Spon's Dictionary of Engineering* (E & F. N. Spon, 1874, p. 1900). It states: "some lines of water are carried towards the sides, either by a divergent direction, by an attractive action, or by the two causes united. As soon as they arrive in contact, they are strongly retained by molecular attraction . . . by an effect of this same force they draw the neighboring lines, and by degrees the whole vein, which then rushes out, filling the tube, and passes through the contracted section more rapidly." However, "by rubbing tallow or wax on the sides, the water will not follow them as it did before." (Spon, 1874, p. 1900) This seems to imply that the hydrophobic-hydrophilic nature of the pipe surface could affect the ability of the water to attach to the pipe wall and thus affect both the ability of the pipe to fill and to form a boundary layer. Because both the boundary layer and the filling of the pipe are important aspects of diffuser function, it seemed prudent to test possible materials before investing in the construction of the large diffuser planned for the Thorndike field test. Miller notes that surface properties have a definite effect on flow through lab scale models. However, surface properties produce a negligible effect at full scale (Miller personal communication Jun. 28, 2016).

Laboratory data was available from Venegas (1950) experiments with Plexiglas box culvert models with and without diffusers. The straight culvert model was 3" by 3" and 24" long. The diffuser model was a 3" by 3" box section 18" long followed by a 6" long diffuser with a 10° total flare angle (5° half flare angle) on the vertical sides; the top and bottom were not flared. For the current project, two fiberglass models were made to these same specifications, one with a gel coat surface and the other with a fiberglass resin surface.

The models were tested at the University of Maine at Orono (UMO) Civil Engineering Hydraulics Lab. This flume unfortunately had a lower capacity than anticipated, and was limited to a maximum flow rate of 0.22 $ft^3/s$. This limited the maximum head that could be tested.

A mount was constructed so that the models could be easily exchanged in the flume. Flow rates and inlet and outlet water levels were recorded. From this data, performance curves were generated.

The performance of the two fiberglass diffuser models was not significantly different from each other. However, both models performed slightly better than Venegas' Plexiglas diffuser model (approximately 8% better). This could be attributable to different lab set-ups, to slight differences in the configuration of the models, or to the surface properties of the models.

Figure 14:
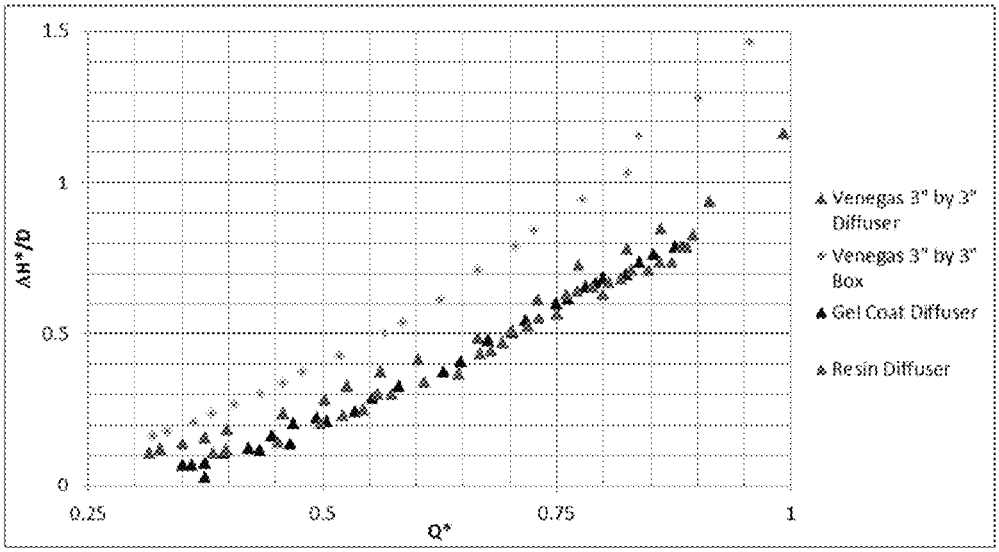
FIG. 14 depicts, in graphical format, the performance curves of the Venegas and the Maine DOT diffuser models.

FIG. 14 shows performance curves for Venegas' box culvert with a diffuser outlet (represented by red triangles), his box model without a diffuser (represented by orange diamonds), the Gel Coat fiberglass box culvert with a diffuser (represented by black triangles), and the Resin fiberglass box culvert with a diffuser (represented by blue triangles) tested at the UMO flume.

Note that Venegas' culvert with a diffuser performed approximately 17% better than his straight culvert, and the Maine DOT diffuser models performed approximately 23% better than Venegas' straight culvert. Although this is not as impressive as Yarnell's 60% increased capacity, it is nonetheless significant. Yarnell's superior performance is due to a better design. Yarnell used a rounded inlet and a diffuser with a larger area ratio, $A_R$=2. Venegas had an unimproved inlet and a low area ratio, $A_R$=1.34.

Based on the comparison of the UMO flume data with Venegas' data, it was concluded that fiberglass would be a viable material for the diffuser outlet to be used in the Thorndike field tests. In addition, it was noted that the resin coat fiberglass diffuser was transparent enough to observe the transition from water to air as the flow detached from the diffuser. Since attachment is necessary for effective diffuser function, the ability to observe attachment was incorporated into the Thorndike diffuser design.

There is an undersized pipe on Cilley Road, a local discontinued road in Thorndike, Me., where the stream regularly overtops the dirt road. This seemed like an ideal place to explore diffuser performance in a real world setting. Because it was local, the location was easy to monitor for rainfall and flooding. Because the pipe was small, only 15" in diameter, and the inlet pool helped to regulate flow, the scale was manageable. A relatively small diffuser could be constructed and installed with minimal cost and equipment. Furthermore the observations and the installation were facilitated by the lack of traffic.

Figure 15:
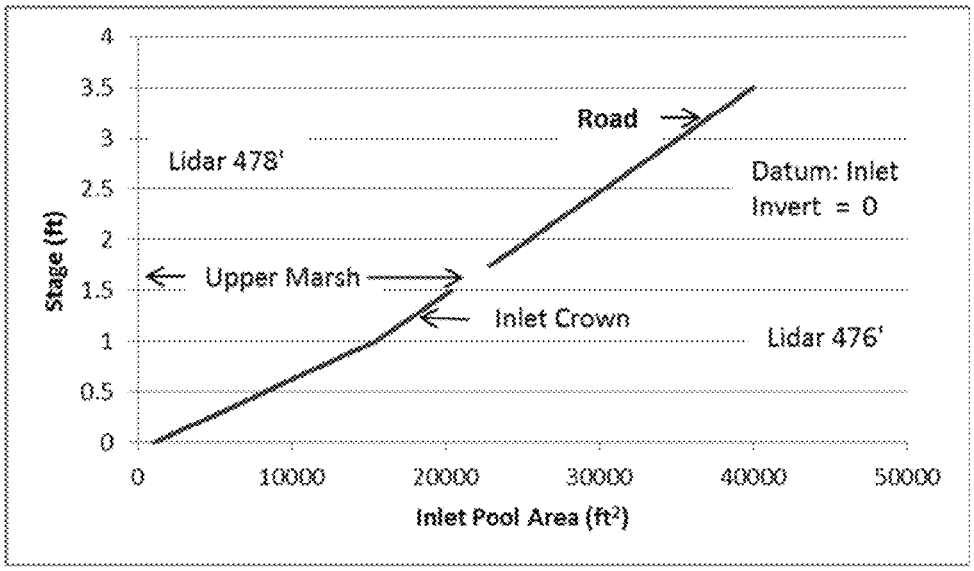
FIG. 15 depicts, in graphical format, the inlet pool water surface area relative to water levels.

Starting in 2009, rainfall, water levels, and conditions when the pipe was operating under pressure flow were observed and recorded. Water depth loggers and a rain gage were installed in 2013. The site is located a half mile down the Cilley Road from the intersection of Files Hill Road and East Thorndike Road in the town of Thorndike, Me. The drainage area for this stream, a tributary to Wing Brook, is 0.52 square miles. The stream flows through a large wetland, which covers 9.62% of the drainage area. A beaver dam approximately 200' upstream from the pipe creates a large upper storage area. Between the beaver dam and the road, there is a lower storage area that acts as in inlet pool. The height of the road is 3.25' above the culvert invert, but stones along the upstream side of the road allow water to pond roughly 3" above the road surface. Two-foot Lidar contours were superimposed on the Site Map, and the 476' and 478' contours between the road and the upper beaver dam were used to define the inlet pool and to estimate the surface area and volume of the water in the pool at different water levels. These estimates are presented in FIG. 29 and graphically in FIG. 15.

The original pipe was a 15" diameter 12' long smooth cast iron pipe (CIP). Given the size of the drainage, a 4' diameter pipe would be appropriate, making this pipe significantly undersized. The pipe was most likely installed in the early 1900s, and had rusted through in places near the inlet and outlet. The pipe had a reverse slope, with a 0.85" rise over the 12' length. The inlet to the pipe was set into the stone headwall and overhung by large flat stones, creating the effect of a hooded inlet. The second pipe, installed by the local property owner, was a 15" "repurposed" corrugated metal pipe (CMP). The pipe outlet was flush with the bottom of the downstream channel, and the banks were approximately 1.5' above the channel. The channel had a very low slope. Rough stone outlet weirs were assembled approximately 9' from the end of the pipe to create an outlet pool.

Starting in October, 2009, a calibrated cylinder rain gage was used to collect year round precipitation data. Starting Apr. 15, 2013, a tipping-bucket rain gage was used in addition to the calibrated cylinder gage. The tipping-bucket gage was calibrated using storm totals from the cylinder gage. The tipping-bucket was retired each fall when freezing temperatures were likely, generally around November 1.

Figure 16:
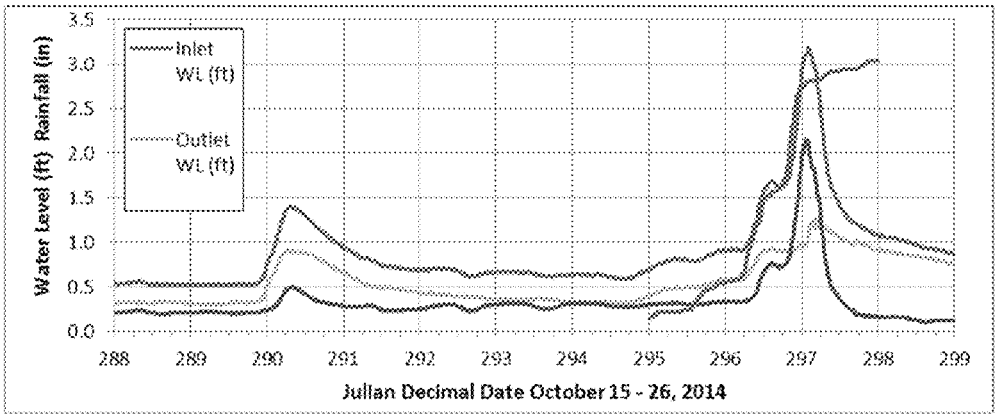
FIG. 16 depicts, in graphical format, water levels and rainfall for two storm events in October of 2014.

Solinst Level Loggers were installed in the inlet and outlet pools on Mar. 30, 2013. The head ($\Delta H$) was determined by subtracting the outlet level from the inlet level. The Level Loggers are unvented and read total pressure so it was necessary to subtract barometric pressure from the level loggers. Local barometric pressure was initially collected from online sources. In spring 2015, a Solinst Baralogger was set up to take barometric pressure readings locally. FIG. 16 shows hydrographs and cumulative rainfall for two storm events in October 2014.

Figure 17:
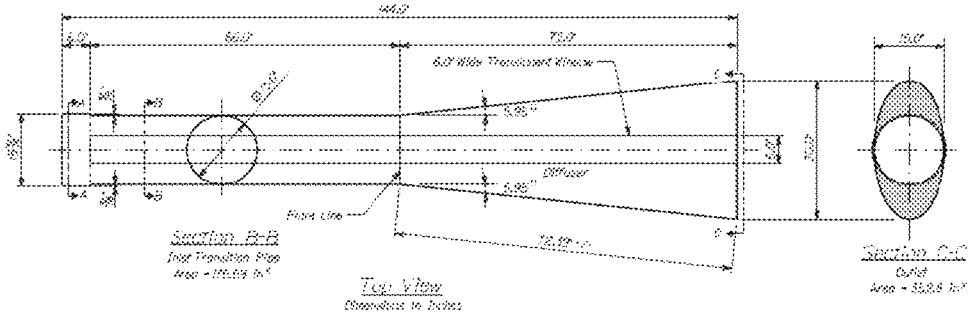
FIG. 17 depicts a schematic side view of one embodiment of a pipe with an oval outlet diffuser.

During 2015, the diffuser was designed and built. The design of the diffuser is shown in FIG. 17. The diffuser was fabricated from ⅜" fiberglass. The outside surface was covered with a UV resistant coating, with the exception of a 6" wide viewing area at the top that runs the length of both the diffuser and the pipe. This window allows observation of the transition from attached to detached flow. The diffuser expands from a circular pipe to a horizontal oval outlet with a total flare angle of 11.9° (5.95° half flare angle) in the horizontal plane and a width of 30". The diffuser section is 6' long, with an area ratio ($A_R$) of 2. At the inlet end of the diffuser, a 6' long straight pipe section was incorporated. This was included because the holes in the CIP pipe would likely prevent the development of the vacuum necessary for the diffuser to function. Three flanges were added on the outside of the pipe to allow the pipe to be secured in place. At the inlet to the pipe section, a socket was incorporated to allow the CIP pipe to be inserted, and to allow the inner surface of the diffuser pipe to be continuous with the CIP pipe. Kenway Corporation of Augusta, Me. fabricated the pipe and diffuser for $5110.00.

The installation of the diffuser turned out to be reasonably quick and easy. The abutting landowner had a small tractor with a bucket, which he used to remove the previously mentioned large rock that had been dislodged and was sitting in the channel where the diffuser was to be installed. It also became apparent that the CMP pipe that had been installed would interfere with the installation of the diffuser, and the tractor was used to bend it out of the way. The diffuser was then carried by hand and placed in position. Tar paper was placed over the joint between the CIP and the fiberglass pipe, and sand and stones were placed over this junction. Metal hoops in front of the flanges and sand bags on the top and sides were used to secure the pipe and diffuser in place.

After the diffuser installation was completed, the outlet weirs were reset approximately 9' from the diffuser outlet to accommodate the additional pipe length.

Figure 18:
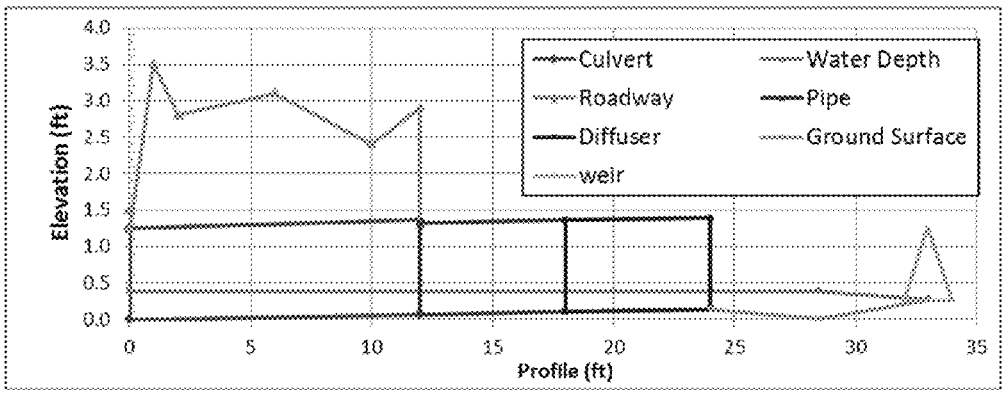
FIG. 18 depicts, in graphical format, the profile of a pipe, diffuser, and outlet weir at the road crossing. (Vertical scale is exaggerated.)

FIG. 18 provides the geometric characteristics of the profile of the diffuser site. Note the slight reverse slope to culvert and diffuser. The weir includes a one foot wide outlet channel that is offset approximately 2' to the right of where the projected centerline of the diffuser intersects the weir. This allows the pool to drain to the level shown in the chart.

From the beginning of data collection in October, 2009 until the installation of the diffuser in September, 2015, the stream overtopped the road an average of 2 to 3 times per year. The combination of rainfall data, water level data and observations prior to the installation of the diffuser indicated that in general, 1.5" of rainfall were required for the pipe to fill and 3" were required for the stream to overtop the road. However, rainfall data does not tell the whole story. Three inches of rain falling onto frozen ground with snow cover during a warm winter rainstorm affects runoff and resulting water levels very differently than 3" of rain on a day during a dry summer.

The winter following the installation of the diffuser was unusual in that it was an "El Nino" year, with warmer and rainier weather. During the fall and winter of 2015-2016, with the combination of rainfall and snowmelt, the stream overtopped the road 4 times. The previous El Nino in 2010 was similar, with 5 storms with over 3" of rain during the late fall and winter.

Figure 19:
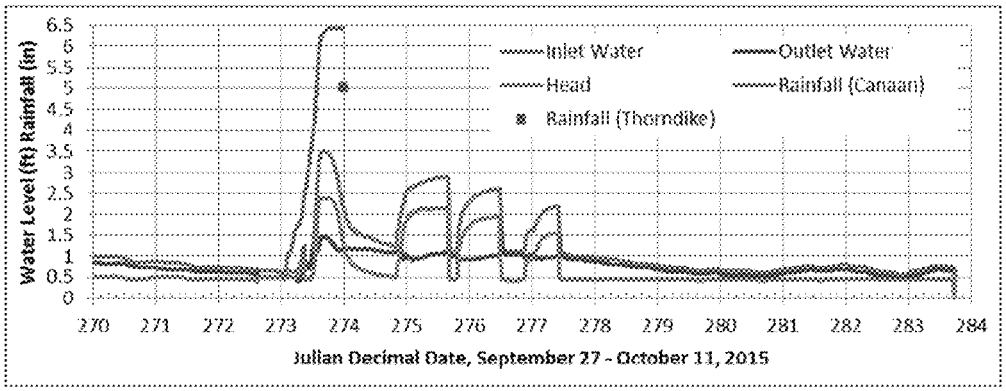
FIG. 19 depicts, in graphical format, hydrographs of the September 30th storm and the three subsequent beaver-generated drawdowns.

The diffuser was installed on Sep. 17, 2015. On September 30, 5" of rain fell in approximately 16 hours. This was the largest rainfall event recorded since the beginning of data collection for this project, and is considered a 75 year rainfall event for this location (NOAA Atlas 14, Volume 10, Version 2). The capacity of the diffuser and the culvert was exceeded, and the stream overtopped the road. The maximum inlet water elevation during this storm was 3.54', 0.29' above the road elevation. The water in the outlet pool stabilized approximately 2.8" over the top of the diffuser, which was full and appeared to be working well. As the inlet water dropped, the outlet pool also dropped, and when the pool reached a level of approximately 1" below the top of the diffuser, the flow detached from the diffuser. The hydrograph of this event indicates the diffuser was operating for about 9.25 hrs. As this was the first major rainfall event, it was good to see that the installation had been successful and the diffuser and the outlet weirs incurred no damage from such a significant storm. FIG. 19 is a hydrograph of this storm and three subsequent beaver-generated drawdowns. On the vertical axis, the numerical values refer to feet for the water level and inches for the rainfall.

FIG. 20 records major rainfall events during the fall, winter and spring of 2015-2016, presenting peak flows and observations regarding the operation of the diffuser. This figure highlights two important points. First, the inlet has a significant impact on the diffuser. As previously mentioned, during the February 17 event, despite the 3' inlet water level, the flow was not attached to the diffuser. An inspection of the inlet showed that the headwall had been damaged. A number of stones were missing, essentially creating a projecting inlet. Simple projecting inlets are much less efficient than hooded or tapered bell inlets, and inhibit development of full pipe flow. The inlet was repaired, with the missing stones replaced. During two storms that followed, the diffuser was once again fully functional at a peak water level of 2.36' and 3.25'.

Second, although the diffuser was not functioning at a peak water level of 2.03' (March 27-28), it was functioning at a peak level of 2.11' (October 29). This gives an indication of the necessary inlet level required to activate the diffuser.

FIG. 21 records the effect of the receding inlet level on the attachment of water to the diffuser during the October 29 rainfall event. As can be seen in this figure, as the water recedes, the flow remains attached to the diffuser at an inlet level of 2.03'. When the same level was a peak level on March 27-28, rather than a receding level, there was no attachment to the diffuser. Although more data would be necessary to confirm this, it appears that the inlet level at which the flow attaches to the diffuser as the water rises is higher than the level at which the water detaches as the inlet level recedes, suggesting a hysteresis in the attachment/detachment phenomenon. A possible explanation for this is that the vacuum created by the diffuser once it is fully functional may help to maintain the attachment of the water to the diffuser wall.

FIG. 21 also shows that the transition from fully attached to fully detached flow in the diffuser occurs in a very narrow range. The water in the diffuser went from fully attached at an inlet level of 2.03' and an outlet level of 1.17' to fully detached at an inlet level of 2.00' and an outlet level of 1.16'. This is an inlet difference of 0.36" and an outlet difference of 0.1". Above this transition, the diffuser is fully functioning. Below this transition, the lack of attached flow does not allow the vacuum to exist that significantly increases flow.

Although the diffuser performed well during storm events, the stream continued to overtop the road. This is not a reflection on the efficacy of the diffuser, but on how massively undersized the pipe was to begin with. As previously mentioned, based on the drainage area, a 4' pipe would be required. This difference in capacity was beyond what the diffuser could remedy.

During a storm event, there are interacting and uncontrolled variables that affect the amount of runoff entering the inlet pool, such as changing rainfall intensities and the effect of snowmelt during winter events. This makes it difficult to accurately quantify the flow rate through the pipe by hydrologic methods, and therefore difficult to create accurate empirical performance curves. In order to create accurate empirical performance curves, a method of creating controlled drawdown data was developed. This method does not rely on hydrologic calculation and therefore is an independent check on the hydrologic model.

Another major advantage of the controlled drawdown method is that it does not rely on major storms for the collection of data, and it allows experiments to be repeatable and reproducible.

A 15" mooring buoy proved to be an ideal piece of equipment for creating a controlled drawdown. It closely fit the pipe, blocking most of the flow and allowing the inlet pool to fill, and it had an attachment point that allowed the connection of a chain and come-along (i.e. a portable winch). Several trial runs were successfully conducted. For the actual drawdown trial, the inlet pool level logger was switched to 1 minute intervals.

Figure 22:
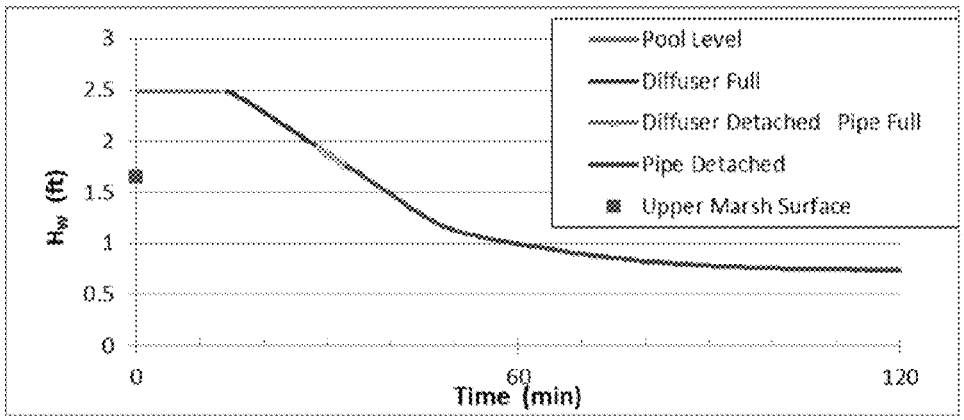
FIG. 22 depicts, in graphical format, the Apr. 18, 2016 drawdown curve for the experimental diffuser.

At 5:20 AM on Apr. 18, 2016, the mooring buoy was attached to the chain and come-along and placed in the inlet. It took 13.5 hours for the pool to fill to a maximum inlet water level of 2.54'. The inlet pool stabilized at this level because of leakage through the second pipe and around the mooring ball. At 6:51 PM, the buoy was removed from the pipe, and the pool began to drain. The drawdown curve for this trial is shown in FIG. 22.

Note that drawdown continues at a constant rate even after the flow detaches from the diffuser. This is believed to be related to the positive effect the flared outlet has on reducing transition losses in open channel (free surface) flow conditions. This association was noted by Hinds in his paper "Flume and Siphon Transitions" (Hinds, 1927). This suggests that diffusers offer real benefits even when they are not operating under pressure flow.

Figures 24, 25:
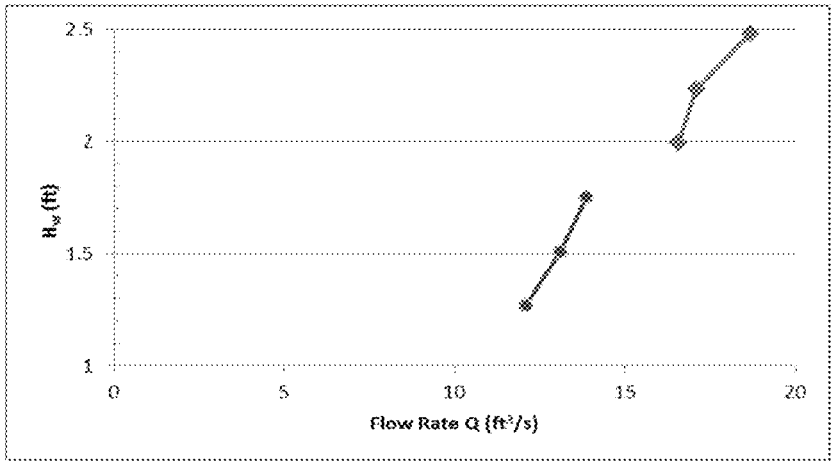
FIG. 24 depicts, in graphical format, the comparison of flow rates and velocities during drawdown analysis, Apr. 18, 2016.
FIG. 25 depicts, in tabular format, diffuser outlet velocity distributions, at a head of 3.25 feet, on Sep. 30, 2015.

Flow rate (Q), pipe velocity ($V_P$), and diffuser outlet velocity ($V_D$) were calculated using the drawdown data and the stage-surface area function listed in FIG. 29. In FIG. 23, Column 1 shows the inlet water surface level above the invert, based on physical measurement and level logger data. The interval of these measurements was 0.25 ft. Column 2 gives dimensionless head ($H_W/D$) used subsequently in drawdown analysis calculations (see FIG. 24). Column 3 is the estimated water surface area at the given elevation based on Lidar contours and listed in Table 1. Column 4 gives rates of change for the head water level ($\Delta H_W$) as measured by the level loggers at the given intervals. Because the changes in level were small, and near the accuracy limits of the logger, two adjoining minutes are recorded and used to calculate flow rates. An estimated leakage of 1 $ft^3$/sec is then subtracted from these flow rates, and the results are listed in Column 5 ($Q_{tota}l-Q_{leakage}$). The two sequential measurements are then averaged in Column 6 ($Q_{avg}$). These average flow rates are divided by pipe area to calculate the mean pipe velocity in Column 7 ($V_P$). The pipe velocity, $V_P$, is divided by the area ratio, 2, to calculate the mean velocity at the diffuser outlet in Column 8, ($V_D$). FIG. 24 plots flow rates. (Note the shift in performance when the flow detaches from the diffuser at stage h=2'; this is illustrated by the gap between the diffuser line (blue) and the pipe line (red).)

Because the flows and velocities were based on inlet pond surface area estimates, a comparison with measured velocity data was used to confirm the validity of these values. During the Sep. 30, 2015 storm when the inlet water level was 3.25', a velocity meter was used to measure the velocity at the diffuser outlet. Velocities were taken at five different locations across the diffuser, 6" above the stream bed. Turbulent fluctuations at the diffuser outlet led to large fluctuations in the velocity readings, which are expressed as ranges in FIG. 25. However, it is clear that the velocity is highest in the center and drops off toward the sides of the diffuser. Although these velocity readings are from a higher head, they are consistent with the range found in FIG. 23.

To further substantiate the calculated flow rates from this drawdown analysis, comparison was made between dimensionless performance curves of Yarnell's 18" VCP with diffuser, an optimal CFD model of a pipe with a bell inlet and a diffuser outlet, and this drawdown data. The three different data sets are depicted together in FIG. 26.

The data from the three different sources form a clearly defined curve with minimal scatter. Yarnell used outlet weirs that kept the pipe submerged, and was therefore able to run tests with low heads and low flow rates. Because of his set-up, however, he was unable to test high heads. Therefore, his data covers the lower end of the curve. The Thorndike diffuser was only submerged, and therefore fully functional, at higher heads and higher flow rates. In addition, because of the available flow entering the basin and the low cover over the pipe, there was a limit to the maximum head achievable by the mooring buoy method. Therefore, the Thorndike data is constrained to the central part of the curve. If there had been more flow into the inlet pool, as in a high flow event, and if there were more cover over the pipe, the Thorndike data could have extended farther up the curve. For this site the maximum achievable head ($\Delta H^*=1.6$) is due to the road overtopping elevation.

Figure 26:
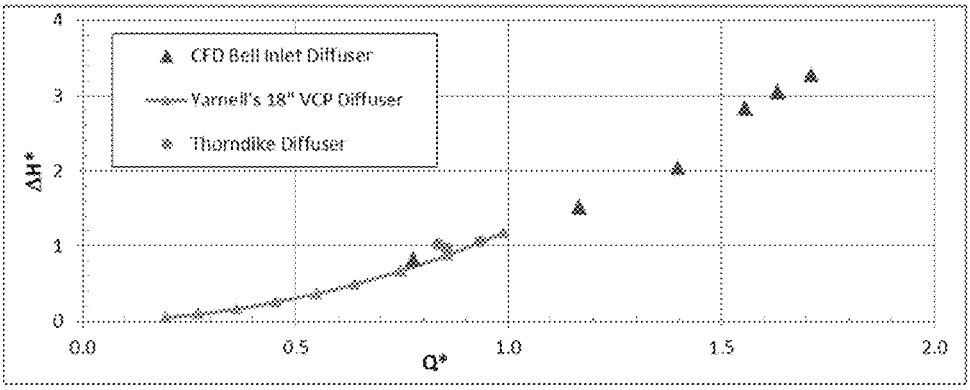
FIG. 26 depicts, in graphical format, the performance curve comparison of the experimental diffuser data to CFD diffuser data & Yarnell's diffuser data.
Figure 27:
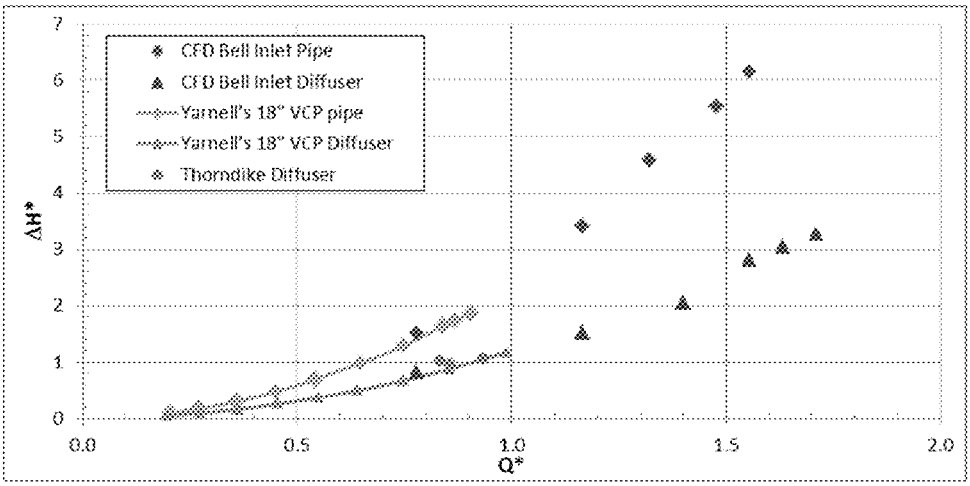
FIG. 27 depicts, in graphical format, diffuser performance relative to straight pipe performance.

In FIG. 26, as well as FIG. 27, dimensionless head difference ($\Delta H^*=\Delta H/D$) was used for Yarnell's data, the CFD data, and the Thorndike diffuser data. The scatter in the Thorndike diffuser data is associated with the estimate of water surface area and relative drawdown rate. Improvement in the stage water surface area curve is possible with more advanced analysis of the Lidar data. This will reduce the scatter in the calculated flows.

In addition to providing flow rates and performance data, the ability to create artificial drawdowns allows a method for testing the installation of a pipe system for function and capacity before a major storm event. This allows for adjustments to the inlet flow configuration and the outlet weir geometry to assure stable operation, maximize performance, assess actual capacity, determine outlet velocity and assess how the flow would affect the weirs and the downstream channel.

The combination of drawdown testing and performance during storm events prove both the efficacy of this specific diffuser design and the concept that diffusers can be utilized to increase capacity and decrease outlet velocity in actual field situations. To the best of our knowledge, this is the first successful field test of a diffuser in a highway application. The only other known field tests were the California diffusers, which were not considered successful.

Each of the components of a diffuser pipe system needs careful consideration. Suggestions follow.

Inlet Pool: Diffusers begin to be effective when the headwater ($H_W$) has a depth of 1.6 pipe diameters (D). As the head increases, so does the performance of the diffuser. It is therefore recommended that diffusers be used in situations where there is enough fill above the pipe to allow ponding of at least 2.5 pipe diameters above the invert. Since shallow pipes are relatively easy to replace, they are not likely candidates for diffusers. Pipes in deep fills benefit from the potential head created by the fill, and are costly to replace. They are therefore good candidates for diffusers.

Understanding the topographic characteristics of the inlet pool can be important, especially if the stream entering the pool is not aligned with the diffuser inlet. This becomes less problematic as the water level increases and the flow into the inlet is driven by the pressure head of the water in the pool, rather than directly from the stream flow. In some cases, modification of the inlet pool would be beneficial.

Improved Pipe Inlets: Much research in the past has focused on inlet design. Because diffusers must be under outlet control to be fully functional, it is important that inlet losses be minimized by the use of an improved inlet. Bell inlets are a commonly used improvement for round culverts, and are often attached to slip-lined pipes. The combination of a bell inlet and a tapered throat would be a further improvement. For square culverts, side tapered inlets are the preferred inlet improvement. In addition, for both pipes and box culverts, hooded inlets can be beneficially paired with a diffuser outlet. Hooded inlets force pipes to fill at very low heads, causing the pipe to operate under outlet control. They also minimize the formation of vortices that draw air into the inlet. Hooded inlets would work well with bell and tapered inlets and are especially advantageous in situations with cover between 2D and 3D, where vortices can be drawn into the inlet, disrupting flow.

Diffuser Outlet Design: The most important design considerations for diffusers are flare angle and area ratio. Horizontally flared outlets with total flare angles of 10° to 12° (half flare angle 5° to 6°) have been shown to have the best performance and to produce stable flow. From a sample size of one (this field project), it appears that a round pipe flaring to an oval diffuser outlet with a 12° total flare angle (6° half flare angle) is effective.

An area ratio $A_R=A_O/A_P$ of 2 to 3 is considered optimal for diffuser design. The area ratio determines the outlet velocity relative to the pipe velocity. The flare angle combined with the area ratio will determine the length of the diffuser. If a given length is required, this length, paired with the flare angle will determine the area ratio (see FIG. 6). Of these three variables, the flare angle is most important for diffuser function.

Outlet weirs: Because diffuser outlets must be submerged to be fully functional, outlet weirs are used to create an outlet pool. The weir must be high enough to pond water to the height of the top of the diffuser during high flows. The weir would be designed for a specific design flow, as discussed above. As a rule of thumb, the weir should be located at least 1.5 diffuser lengths from the end of the diffuser.

Properly designed diffusers are effective at both increasing pipe capacity and decreasing outlet velocity. Diffusers provide a straight-forward, inexpensive, and non-disruptive method of both retrofitting and improving the performance of existing pipes that are either undersized or in need of repair. The combination of the literature review and the CFD modeling that were part of this research provided both support for the concept and enough information and background to successfully design, install, and test the Thorndike prototype diffuser system. The work of Venturi and Yarnell clearly demonstrated the ability of diffusers to increase flow rates. Their work gave detailed information about effective designs for improved inlets and diffuser outlets, as well as data strongly supporting their use in combination. CFD modeling allowed the exploration and refinement of diffuser system designs. Visual depiction of pressure and flow fields helped provide further understanding of the dynamics of diffuser system function. During the research and development of field diffusers, the use of CFD modeling provides a powerful tool that can be used to design and pre-test diffuser systems, especially in situations where site conditions preclude following suggested design guidance. The Thorndike diffuser proved to be both inexpensive and easy to install. The stable flow consistently observed during high flow events was an indication of reliable performance. The implementation of a method of creating artificial drawdowns provided data that agreed with both Yarnell's data and CFD modeling. The performance curves in FIG. 27, created from Yarnell's data, an optimal CFD diffuser system, and the Thorndike data, show the consistency of diffuser performance as well as the significant improvement in performance of diffuser systems over straight pipes. To the best of our knowledge, this is the first successful field test of a diffuser in a highway application. The only other known field tests were the California diffusers, which were not considered successful.

The importance of understanding the specific design requirements of diffuser systems cannot be overstated. These requirements, though not generally onerous, are necessary, and failure to incorporate them into diffuser system design is likely to lead poor performance. The following design considerations are important:

- Adequate cover over the pipe to allow for the necessary head
- Symmetric flow into inlet; may require modifications to inlet area
- Improved inlet: bell, tapered and/or hooded
- Proper diffuser design: oval or rectangular with correct flare angle Wide flare angles will perform poorly.
- Outlet weirs to provide submergence of the diffuser outlet Changing weather patterns with increasing intensities of rainfall make this research particularly timely. Diffuser systems provide an effective adaptation to the demands of increasing flow, aging infrastructure, and limited financial resources.

Definitions

Adverse Pressure Gradient—A condition where the pressure increases along a streamline in the downstream direction. In a diffuser, this is related to the flow expanding and slowing in the diffuser cone. Much of the kinetic energy from the decrease in velocity is converted directly into potential energy which results in the adverse pressure gradient. In diffusers the adverse pressure gradient is also enhanced by the vacuum that forms at the diffuser inlet.

Area Ratio—The area ratio compares the diffuser outlet area to the diffuser inlet area, $A_R$=Ao/Ap. The change in the fluid's velocity between the inlet and outlet of the diffuser when the outlet flow is symmetric and attached to the diffuser walls is directly related to the area ratio. The Borda-Carnot equation uses an inverse of the area ratio to determine the outlet loss coefficient (see FIG. 6).

Attached Flow—Attached flow in a diffuser is a condition where the velocity is zero at the wall and consistently increases away from the wall. The near wall portion of the attached flow is called the boundary layer. Flow attachment is crucial for the formation of the boundary layer, which plays a central role in diffuser function.

Bell Inlet—An inlet that has a curved expanding opening. A radius of curvature of 0.14 pipe diameters is typically considered optimal. The entrance loss coefficient with this type of opening is 0.2.

Boundary Layer—A typically thin layer of fluid near a solid boundary that has zero velocity at the solid boundary surface and rapidly increases away from the surface. The boundary layer in a diffuser is thicker than is typically encountered in a pipe, with the thickness increasing as it moves farther into the diffuser from the throat (see FIGS. 8 and 9). The thickened boundary layer is associated with the decelerating flow in the adverse pressure gradient. In certain situations, the decreased velocity gradient in the diffuser's boundary layer lacks the energy required to resist the adverse pressure. This can allow the flow to separate from the diffuser wall and backflow to occur.

Conic Outlets—See diffusers. Conic Outlets was the term used in Tredgold's 1862 translation of Venturi's paper.

Detached Flow—The condition that exists when the fluid (water) is no longer able to remain attached to the surface (culvert wall) and air is allowed to enter the culvert. Detached flow is also used as a synonym for separated flow.

Diffuser—A pipe outlet that expands along the flow direction. The expansion can be conic, expanding evenly in all directions, planar, expanding in two directions, or a combination (typically by expanding along the bottom and sides). Diffusers cease to function if the expansion angle is too large. The accepted expansion angles are 6° for conic diffusers, 10° to 11° for rectangular diffusers, and about 12° for oval diffusers. Area Ratios of 2 to 3 are generally accepted as the upper limit for effective diffusers. Miller provides an excellent review of the relationship between the $A_R$ and the non-dimensional length as well as the conditions where an asymmetric diffuser may be appropriate (Miller, 1990, pp. 59-87). The vacuum created at the diffuser inlet, the decreased outlet velocity and increased outlet pressure are utilized in many fluid dynamics situations involving minimizing losses in pipe systems. However, few references are made to the increased flow rate that results from the increased hydraulic gradient created by the vacuum at the diffuser inlet. Diffusers are also known as Conical Outlets (Venturi), Increasers (Yarnell), Siphon Outlets (Hinds), and Flared Siphon Outlets (California DOT).

Drawdown—The rate of drop of the inlet pool's ponded water surface with time. An artificial drawdown can be used to assess pipe capacity, as well as to test an installation. The instantaneous rate of drawdown at a specific water elevation can be used in combination with the surface area of the ponded water at that same elevation to determine the rate of flow out of the pool. If there is inflow into the inlet pool, this inflow must be added.

Flare angle—the angle that the side of a diffuser deviates from the longitudinal axis of the pipe.

Flared Siphon outlets—See diffusers. This term is used by The California Culvert Practice Manual 1940s through 1950s and FHWA HDS 5 from 2012.

Hood—A projection over the inlet to a pipe that allows the pipe to fill at low inlet water levels and prevents vortices from forming at the pipe inlet. See Blaisdell's paper on Hooded Inlets for a more complete review (Blaisdell, 1958).

Hydraulic Gradient—The change in pressure with distance, typically along a pipe. This is associated with the friction losses along the system and the pressure difference (head) imposed on the system. The vacuum created at the diffuser inlet increases the hydraulic gradient through the entire pipe. In a diffuser outlet, the hydraulic gradient opposes the flow and is typically referred to as an Adverse Pressure Gradient.

Jet—High Velocity flow through an orifice, often referring to the flow exiting a pipe.

Momentum—The form of energy combining the flow rate (Q), the fluids density (p), and the fluids velocity (V) as defined in Newton's Second Law (F=ma). This law states that a force is required to change the momentum of an object or fluid.

Non-Dimensional Length—The non-dimensional length ($N/R_1$) relates the diffuser length (N or L) to the pipe radius ($R_1$) or box culvert width (W). Non-dimensional length allows comparison of diffusers of different sizes based on geometric relationships. See Miller, 1990 p. 68 for further discussion.

Separated Flow—The condition that exists when the boundary layer separates from the wall of a pipe or diffuser. Streamlines of the fluid move away from the wall and allow eddies and reversing flow to occupy the separated zone. The strong adverse pressure gradient in diffuser outlets is closely associated with flow separation. Separation frequently occurs in diffusers with wide flare angles and also with non-symmetric inlet flows. Separated flow is able to oscillate in the diffuser cone, which results in large pressure fluctuations, loss of the diffuser inlet vacuum, little decrease in outlet velocity, and little increase in flow rate. This is associated with a large increase in outlet losses and a high outlet loss coefficient relative to stable diffusers.

Siphon outlets—See diffusers. This is the name Hinds (1927) used for diffusers.

Symmetric Flow—Flow that is uniformly distributed across the pipe or diffuser cross-section.

Throat—The transition from the pipe to the diffuser.

Transitions—A change in area either at an inlet or at an outlet of a fluid passage is referred to as a transition. In inlet transitions, pressure drives the flow and smooth curved surfaces are required to prevent flow separation. In properly designed outlet transitions, the geometry of the transition reflects the momentum of the fluid. For example, a well-designed outlet diffuser reflects the natural expansion of the water leaving the pipe, and mechanically confines it to prevent separation. Transitions in horizontally expanding channels and diffusers have an optimum total divergence angle of about 12°. The loss coefficient at an inlet or an outlet is directly related to the effectiveness of the flow transition.

Vacuum—A condition where pressure falls below atmospheric pressure. In this report, the reduced pressure at the diffuser inlet is referred to as the vacuum pressure even if it does not fall below atmospheric pressure, because it is significantly lower than the pressure at the outlet of the diffuser. The diffuser vacuum pressure could be above atmospheric pressure if the diffuser outlet is significantly submerged. However, the hydraulic gradient and flow rate will still be increased in proportion to the effective head, the difference between the inlet pressure and the vacuum pressure at the diffuser inlet.

DETAILED DESCRIPTION OF INVENTION

The present invention comprises a culvert diffuser 100 configured to be used as part of a culvert 1 installation. Such culverts 1 are configured to have an inlet 10, an outlet 20, an inside diameter 30, a cross-sectional area 40, and a longitudinal axis 50. Typically, culverts 1 are formed as straight pipes having cylindrical cross-sections, but they may also have rectangular or square cross-sections (these are known as box culverts). Culverts 1 are typically made of corrugated metal, cast iron, vitrified clay, fiberglass, polyvinyl chloride, or other composite materials.

The diffuser 100 of the present invention is designed to alter the geometry of the outlet 20 of the culvert 1. It comprises a body member 101, with the body member 101 having a continuous sidewall 160, a proximate end 110, a distal end 120, a proximate opening 130 at its proximate end 110, and an outlet opening 150 at its distal end 120. The proximate opening 130 of the body member 101 of the diffuser 100 has an inside diameter 140 which is substantially the same as the inside diameter 30 of the culvert 1. This allows for the proximate end 110 of the body member 101 of the diffuser 100 to be connected to the outlet 20 of the culvert 1 without gapping, providing a water-tight connection. The diffuser 100 can be made of any suitable material, with the preferred material being fiberglass.

The sidewall 160 of the body member 101 of the diffuser 100 angles outward from the longitudinal axis 50 of the culvert 1. This results in the outlet opening 150 of the body member 101 of the diffuser 100 having a cross-sectional area 152 which is greater than the cross-sectional area 40 of the culvert 1. In some embodiments the cross-sectional area 152 of the outlet opening 150 of the diffuser 100 is between two and three times the cross-sectional area 40 of the culvert 1. In the preferred embodiment the cross-sectional area 152 of the outlet opening 150 of the diffuser 100 is two times the cross-sectional area 40 of the culvert 1. The outlet opening 150 of the body member 101 can have any suitable shape; for example, a conical sidewall 160 results in the outlet opening 150 having a substantially circular shape, while a boxed sidewall 160 results in the outlet opening 150 having a substantially rectangular shape. In the preferred embodiment, the sidewall 160 flares only laterally, providing for the outlet opening 150 having a substantially oval shape.

In one embodiment of the present invention, the sidewall 160 of the body member 101 of the diffuser 100 is formed of a first lateral portion 162, a second lateral portion 164, an upper portion 166, and a lower portion 168. The first lateral portion 162 of the sidewall 160 angles outwardly at a first flare angle 172 from the longitudinal axis 50 of the culvert 1. Likewise, the second lateral portion 164 of the sidewall 160 angles outwardly at a second flare angle 174 from the longitudinal axis 50 of the culvert 1, with the first and second flare angles 172,174 being substantially the same. The upper portion 166 of the sidewall 160 extends outward substantially parallel to the longitudinal axis 50 of the culvert 1, as does the lower portion 168 of the sidewall 160. Differently sized flare angles 172,174 may be used. In the preferred embodiments the first flare angle 172 is between five and seven degrees and the second flare angle 174 is between five and seven degrees. In the most preferred embodiments the first flare angle 172 and the second flare angle 174 are each about six degrees. This maximizes attachment of the water flow through the diffuser 100. A first distance 182 is measured from the upper portion 166 of the sidewall 160 at the outlet opening 150 to the lower portion 168 of the sidewall 160 at the outlet opening 150; this first distance 182 is substantially the same as the inside diameter 30 of the culvert 1. A second distance 184 is measured from the first lateral portion 162 of the sidewall 160 at the outlet opening 150 to the second lateral portion 164 of the sidewall 160 at the outlet opening 150; this second distance 184 is substantially twice the inside diameter 30 of the culvert 1.

The combination of the sizes of the first and second flare angles 172,174 and the cross-sectional area 152 of the outlet opening 150 of the diffuser dictate the overall length of the diffuser. In the preferred embodiment, where the first and second flare angles 172,174 are about six degrees each, and the cross-sectional area 152 of the outlet opening 150 of the diffuser is about twice the cross-sectional area 30 of the culvert, the overall length of the diffuser 100 is about five times the cross-sectional area 30 of the culvert.

In another embodiment of the present invention, a culvert diffuser system 200 is presented. The culvert diffuser system 200 comprises a culvert pipe 201, a culvert diffuser 300, a culvert inlet 400, and an outlet weir 500. The culvert pipe 201 has an inlet end 210, an outlet end 220, an inside diameter, a cross-sectional area, and a longitudinal axis, and is substantially cylindrical and open at its inlet end 210 and its outlet end 220. The culvert diffuser 300 is configured as described above, with a substantially oval opening at its distal end 320. The proximate end 310 of the culvert diffuser 300 has an inside diameter substantially the same as the inside diameter of the culvert pipe 201, so that the proximate end 310 of the culvert diffuser 300 is in water-tight connection with the outlet end 220 of the culvert pipe 201. The culvert inlet 400 has a proximate end 410 and a distal end 420, with the proximate end 410 and the distal end 420 both being opened and the proximate end 410 of the culvert inlet 400 having a greater cross-sectional area than the distal end 420 of the culvert inlet 400. The distal end 420 of the culvert inlet 400 has an inside diameter substantially the same as the inside diameter of the culvert pipe 201, so that the distal end 420 of the culvert inlet 400 is in water-tight connection with the inlet end 210 of the culvert pipe 201. Finally, the outlet weir 500 is an independent structure located some distance from the outlet end 320 of the culvert diffuser 300. The outlet weir 500 has a main body that is capable of substantially diverting the flow of water 700. It is positioned such that its top portion 510 is located higher than the upper portion of the sidewall of the culvert diffuser 300. This allows water 700 to pond up between the outlet weir 500 and the distal end 320 of the culvert diffuser 300, keeping the outlet end 320 of the culvert diffuser 300 fully submerged during high water flows. In the preferred configuration of this embodiment, the outlet weir 500 is located at least 1.5 times the length of the culvert diffuser 300 from the distal end 320 of the culvert diffuser 300.

In this embodiment, the culvert pipe 201 of the culvert diffuser system 200 may be configured to fit within an existing highway culvert 600. This allows for simple and inexpensive repairs to existing highway culverts 600. Though the culvert pipe 201 reduces the inside diameter of the original highway culvert 600, the operation of the culvert diffuser 300 and the culvert inlet 400 allow for greater capacity of water flow through the culvert pipe 201 as a function of cross-sectional area, thereby maintaining or even improving the overall rate of water flow capacity through the culvert diffuser system 200.

Modifications and variations can be made to the disclosed embodiments of the present invention without departing from the subject or spirit of the invention as defined in the following claims.

I claim:

1. A culvert diffuser system comprising a culvert pipe, said culvert pipe having an inlet end, an outlet end, an inside diameter, a cross-sectional area, and a longitudinal axis, wherein said culvert pipe is substantially cylindrical and open at its inlet end and its outlet end;

a culvert diffuser, said culvert diffuser comprising a body member, said body member having a continuous sidewall, a proximate end, a distal end, a length extending from its proximate end to its distal end, a proximate opening at its proximate end, and an outlet opening at its distal end, said proximate opening of the body member of the culvert diffuser having an inside diameter substantially the same as the inside diameter of the culvert pipe, said proximate end of the body member of the culvert diffuser being in connection with the outlet end of the culvert pipe, said outlet opening of the body member of the culvert diffuser being substantially oval in shape such that a cross-sectional area of the outlet opening is greater than the cross-sectional area of the culvert pipe, said sidewall of the body member of the culvert diffuser having a first lateral portion which angles at a first flare angle outwardly from the longitudinal axis of the culvert pipe, a second lateral portion which angles at a second flare angle outwardly from the longitudinal axis of the culvert pipe, an upper portion which extends substantially parallel to the longitudinal axis of the culvert pipe, and a lower portion which extends substantially parallel to the longitudinal axis of the culvert pipe, wherein a first distance measured from the upper portion of the sidewall of the body member of the culvert diffuser at the outlet opening of the body member to the lower portion of the sidewall of the body member of the culvert diffuser at the outlet opening of the body member is substantially the same as the inside diameter of the culvert pipe, and a second distance measured from the first lateral portion of the sidewall of the body member of the culvert diffuser at the outlet opening of the body member to the second lateral portion of the sidewall of the body member of the culvert diffuser at the outlet opening of the body member is substantially twice the inside diameter of the culvert pipe;

a culvert inlet, said culvert inlet having a proximate end and a distal end, with the proximate end and the distal end both being opened and the proximate end of the culvert inlet having a greater cross-sectional area than the distal end of the culvert inlet, with the distal end of said culvert inlet having an inside diameter substantially the same as the inside diameter of the culvert pipe, said distal end of said culvert inlet being in connection with the inlet end of the culvert pipe; and an outlet weir, said outlet weir being a structure having a top portion located higher than the upper portion of the sidewall of the body member of the culvert diffuser and a width greater than the second distance, said outlet weir being located at least 1.5 times the length of the culvert diffuser from the distal end of the culvert diffuser, wherein said outlet weir is configured to cause water to pool between it and the distal end of the culvert diffuser such that the distal end of the culvert diffuser is completely submerged.

2. The culvert diffuser system of claim 1 wherein the cross-sectional area of the outlet opening of the body member of the culvert diffuser is between two and three times the cross-sectional area of the culvert pipe.

3. The culvert diffuser system of claim 1 wherein the cross-sectional area of the outlet opening of the body member of the culvert diffuser is two times the cross-sectional area of the culvert pipe.

4. The culvert diffuser system of claim 1 wherein the first flare angle is substantially the same as the second flare angle.

5. The culvert diffuser system of claim 4 wherein the first flare angle is between five and seven degrees and the second flare angle is between five and seven degrees.

6. The culvert diffuser system of claim 1 wherein the body member of the culvert diffuser is constructed of fiberglass.

7. The culvert diffuser system of claim 1 wherein the culvert pipe is substantially cylindrical, having a substantially circular cross-sectional area, and the proximate end of the body member of the culvert diffuser has a substantially circular cross-sectional area.

8. The culvert diffuser system of claim 1 wherein the culvert pipe is configured to fit within an existing highway culvert.

* * * * *